US009121263B2

(12) United States Patent
Zazovsky et al.

(10) Patent No.: US 9,121,263 B2
(45) Date of Patent: Sep. 1, 2015

(54) CLEANUP PREDICTION AND MONITORING

(75) Inventors: Alexander F. Zazovsky, Sugar Land, TX (US); Alexander Skibin, Moscow (RU); Darya Mustafina, Moscow (RU); Jaideva C. Goswami, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 643 days.

(21) Appl. No.: 12/899,140

(22) Filed: Oct. 6, 2010

(65) Prior Publication Data

US 2011/0087459 A1 Apr. 14, 2011

Related U.S. Application Data

(60) Provisional application No. 61/250,059, filed on Oct. 9, 2009, provisional application No. 61/261,794, filed on Nov. 17, 2009.

(51) Int. Cl.
*G06F 19/00* (2011.01)
*E21B 49/10* (2006.01)

(52) U.S. Cl.
CPC ..... *E21B 49/10* (2013.01)

(58) Field of Classification Search
CPC ..... E21B 49/08; E21B 49/087; E21B 47/102; G01V 8/02
USPC ..... 702/6, 179
See application file for complete search history.

(56) References Cited

U.S. PATENT DOCUMENTS 5,809,458 A * 9/1998 Tamarchenko ..... 702/9
6,289,284 B1 * 9/2001 Yamamoto ..... 702/14
6,388,947 B1 * 5/2002 Washbourne et al. ..... 367/73
6,799,117 B1 * 9/2004 Proett et al. ..... 702/12
7,408,150 B1 * 8/2008 Flaum et al. ..... 250/269.6
2002/0040274 A1 * 4/2002 Yin et al. ..... 702/7
2004/0257240 A1 * 12/2004 Chen et al. ..... 340/853.1
2005/0165553 A1 * 7/2005 Jammes et al. ..... 702/11
2006/0173624 A1 * 8/2006 Frenkel ..... 702/7
2006/0250130 A1 * 11/2006 Akkurt et al. ..... 324/303
2007/0079962 A1 * 4/2007 Zazovsky et al. ..... 166/264
2007/0256489 A1 * 11/2007 Wu et al. ..... 73/152.22

OTHER PUBLICATIONS

Mullins, Oliver C. et al., Real-Time Determination of Filtrate Contamination During Openhole Wireline Sampling by Optical Spectroscopy, SPE 63071, Dallas, Texas, Oct. 1-4, 2000.

Zazovsky, Alexander, Monitoring and Prediction of Cleanup Production During Sampling, SPE 112409, Lafayette, Louisiana, Feb. 13-15, 2008.

* cited by examiner

*Primary Examiner* — Janet Suglo
*Assistant Examiner* — Michael Dalbo
(74) *Attorney, Agent, or Firm* — Cathy Hewitt; Kenneth L. Kincaid

(57) ABSTRACT

The examples described herein relate to methods and apparatus for cleanup prediction and monitoring. A disclosed method of predicting cleanup of a sample fluid obtained by a downhole tool includes drawing the sample fluid into the downhole tool via a probe assembly; measuring optical densities of the sample fluid at a plurality of different respective times; selecting at least some of the measured optical densities as fitting points; identifying one or more inversion parameters; and performing, via a processor, an inversion using the fitting points, the inversion parameters and simulation data to generate data associated with a predicted cleanup of the sample fluid.

21 Claims, 22 Drawing Sheets

Table 1: MDT field data: formation parameters.

| File # PTIM_#_PDS | MD ft | API Gravity | GOR Average | OilVis cp | DDM md/cp | FormPres psi | PresOver psi |
|---|---|---|---|---|---|---|---|
| 142 | 17,934 | 26.6 | 855 | 3.0 | 110 | 10,666 | 794 |
| 134 | 17,792 | 25.9 | 806 | 3.6 | 210 | 10,709 | 798 |
| 138 | 18,011 | 25.6 | 648 | 3.2 | 131 | 10,788 | 856 |
| 145 | 18,048 | 26.8 | 633 | 4.1 | 14 | 10,804 | 859 |
| 140 | 18,072 | 24.9 | 524 | 6.2 | 342 | 10,830 | 852 |
| 146 | 18,146 | 25.2 | 537 | 4.3 | 162 | 11,011 | 718 |
| 236 | 16,690 | 21.6 | 705 | 4.0 | 499 | 9,306 | 1579 |
| 239 | 16,720 | 21.3 | 731 | 3.8 | 247 | 9,313 | 1584 |
| 185 | 17,722 | 23.8 | 787 | 2.8 | 37 | 10,670 | 724 |
| 211 | 17,980 | 20.9 | 809 | 3.3 | 1285 | 10,746 | 789 |
| 190 | 18,051 | 21.0 | 832 | 4.1 | 830 | 10,770 | 818 |
| 210 | 18,231 | 21.8 | 780 | 4.8 | 107 | 10,825 | 869 |
| 207 | 18,481 | 20.8 | 770 | 3.8 | 170 | 10,909 | 951 |
| 192 | 18,578 | 21.4 | 705 | 7.8 | 13 | 10,943 | 987 |
| 205 | 18,823 | 19.5 | 718 | 5.6 | 274 | 11,030 | 1066 |
| 204 | 18,864 | 18.1 | 622 | 16.2 | 108 | 11,052 | 1074 |
| 182 | 17,479 | 22.4 | 868 | 3.0 | 118 | 10,640 | 784 |
| 193 | 17,517 | 23.8 | 680 | 3.4 | 0.8 | 10,646 | 793 |
| 180 | 17,624 | 21.8 | 772 | 4.0 | 37 | 10,674 | 809 |
| 261 | 18,322 | 20.5 | 709 | 5.3 | 209 | 10,912 | 906 |
| 267 | 18,364 | 16.9 | 635 | 16.0 | 68 | 10,932 | 915 |
| 266 | 18,398 | 18.0 | 557 | 18.9 | 188 | 10,932 | 929 |
| 272 | 18,462 | 18.4 | 544 | 14.5 | 118 | 10,962 | 938 |

FIG. 18

Table 2: MDT field data: job operation parameters.

| File # PTIM_#_PDS | Sam DD psi | POV gallon | PO Time s | PO Time min | PO Rate liter/min | PO Rate cc/s |
|---|---|---|---|---|---|---|
| **142** | 266 | 11.5 | 3200 | 53 | 0.82 | 13.60 |
| **134** | 809 | 14.6 | 3400 | 57 | 0.98 | 16.25 |
| **138** | 438 | 15.0 | 2800 | 47 | 1.22 | 20.28 |
| **145** | 1054 | 4.5 | 2500 | 42 | 0.41 | 6.81 |
| **140** | 380 | 15.9 | 4500 | 75 | 0.81 | 13.37 |
| **146** | 261 | 16.1 | 4300 | 72 | 0.85 | 14.17 |
| **236** | 106 | 25.8 | 5800 | 97 | 1.01 | 16.84 |
| **239** | 163 | 16.0 | 3900 | 65 | 0.94 | 15.53 |
| **185** | 820 | 10.2 | 2200 | 37 | 1.06 | 17.55 |
| **211** | 96 | 16.9 | 2800 | 47 | 1.38 | 22.84 |
| **190** | 170 | 16.3 | 2600 | 43 | 1.43 | 23.73 |
| **210** | 225 | 7.3 | 1700 | 28 | 0.98 | 16.25 |
| **207** | 259 | 6.6 | 1500 | 25 | 1.00 | 16.65 |
| **192** | 493 | 19.2 | 3500 | 58 | 1.25 | 20.76 |
| **205** | 280 | 12.8 | 2700 | 45 | 1.08 | 17.94 |
| **204** | 602 | 6.6 | 2600 | 43 | 0.58 | 9.61 |
| **182** | 40 | 15.7 | 4600 | 77 | 0.78 | 12.92 |
| **193** | 1146 | 2.0 | 4100 | 68 | 0.11 | 1.85 |
| **180** | 1074 | 17.2 | 4900 | 82 | 0.80 | 13.29 |
| **261** | 262 | 10.6 | 1900 | 32 | 1.27 | 21.12 |
| **267** | 1682 | 16.7 | 5800 | 97 | 0.66 | 10.90 |
| **266** | 832 | 23.4 | 6600 | 110 | 0.81 | 13.42 |
| **272** | 1962 | 16.2 | 7900 | 132 | 0.47 | 7.76 |

FIG. 19

Table 3: MDT field data: contamination and invasion depth estimates.

| File # PTIM_#_PDS | Color Model % (2002) | GOR Model % (2004) | Lab Test wt% (2006) | CMA % (2008) | Invasion Depth in (2010) |
|---|---|---|---|---|---|
| 142 | 7.0 | 5.0 | 1.0 | 6.8 | 5.1 |
| 134 | 5.0 | 3.0 | 1.5 | 5.0 | 5.8 |
| 138 | 3.0 | 2.0 | 1.5 | 6.1 | 5.9 |
| 145 | 2.5 | 2.0 | 3.5 | 4.8 | 5.8 |
| 140 | 5.0 | 3.0 | 2.5 | 4.9 | 5.0 |
| 146 | 9.0 | 5.0 | 2.5 | 6.1 | 4.7 |
| 236 | 13.0 | 9.0 | 7.2 | 4.4 | 4.3 |
| 239 | 11.0 | 8.0 | 5.5 | 5.1 | 5.2 |
| 185 | 7.0 | 5.0 | 8.2 | 6.2 | 5.3 |
| 211 | 8.0 | 7.0 | 3.8 | 5.5 | 4.1 |
| 190 | 6.0 | 4.0 | 4.5 | 6.2 | 5.7 |
| 210 | 8.0 | 6.0 | 9.7 | 9.5 | 5.4 |
| 207 | 7.0 | 5.0 | 5.5 | 7.7 | 4.2 |
| 192 | 8.0 | 6.0 | 8.1 | 5.2 | 5.0 |
| 205 | 8.0 | 6.0 | 5.1 | 5.0 | 4.7 |
| 204 | 14.0 | 9.0 | 8.7 | 9.3 | 4.7 |
| 182 | 9.0 | 7.0 | 3.2 | 3.0 | 5.1 |
| 193 | 21.0 | 15.0 | 19.0 | 8.2 | 4.2 |
| 180 | 8.0 | 6.0 | 10.6 | 3.9 | 4.2 |
| 261 | 5.0 | 3.0 | 4.2 | 5.6 | 4.3 |
| 267 | 9.0 | 6.0 | 2.0 | 1.9 | 1.3 |
| 266 | 9.0 | 6.0 | 4.7 | 3.4 | 2.7 |
| 272 | 14.0 | 8.0 | 7.3 | 3.6 | 2.2 |

FIG. 20

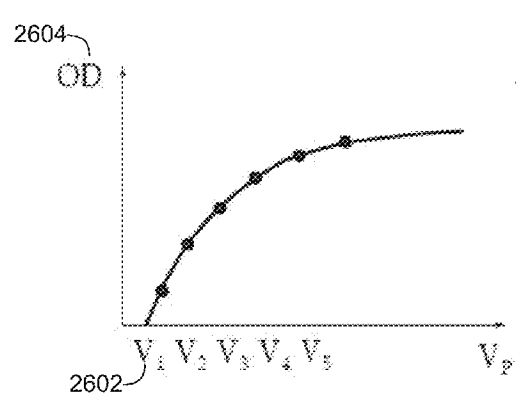
FIG. 26
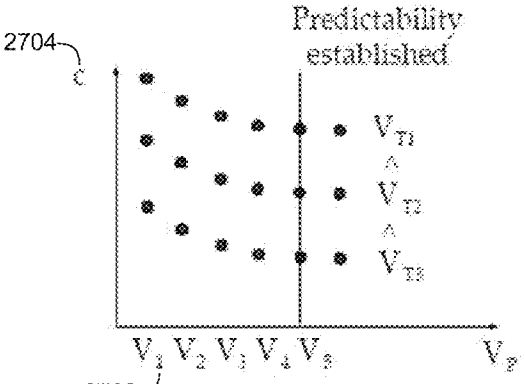
FIG. 27
FIG. 28
FIG. 29

CLEANUP PREDICTION AND MONITORING

CROSS-REFERENCE TO RELATED APPLICATIONS

This application claims the benefit of U.S. Provisional Application No. 61/250,059, filed Oct. 9, 2009, the entire disclosure of which is hereby incorporated herein by reference. This application also claims the benefit of U.S. Provisional Application No. 61/261,794, filed Nov. 17, 2009, the entire disclosure of which is hereby incorporated herein by reference.

BACKGROUND OF THE DISCLOSURE

In sampling operations performed on a subterranean formation, cleanup procedures are typically performed prior to obtaining a fluid sample representative of the formation fluid. To obtain a representative fluid sample, a large amount of time may be needed to sufficiently decrease the level of contaminate(s) (e.g., drilling fluid filtrate) in the formation fluid. For job planning or other purposes, operators may attempt to estimate the amount of time remaining to obtain a representative formation fluid sample and the anticipated level of contamination in the sample to be obtained. However, currently, a significant amount of time is required to acquire data to generate a reasonably accurate estimation.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIGS. 18-20 are example tables according to one or more aspects of the present disclosure.

FIGS. 26-29 are example graphs according to one or more aspects of the present disclosure.

DETAILED DESCRIPTION

Figure 1:
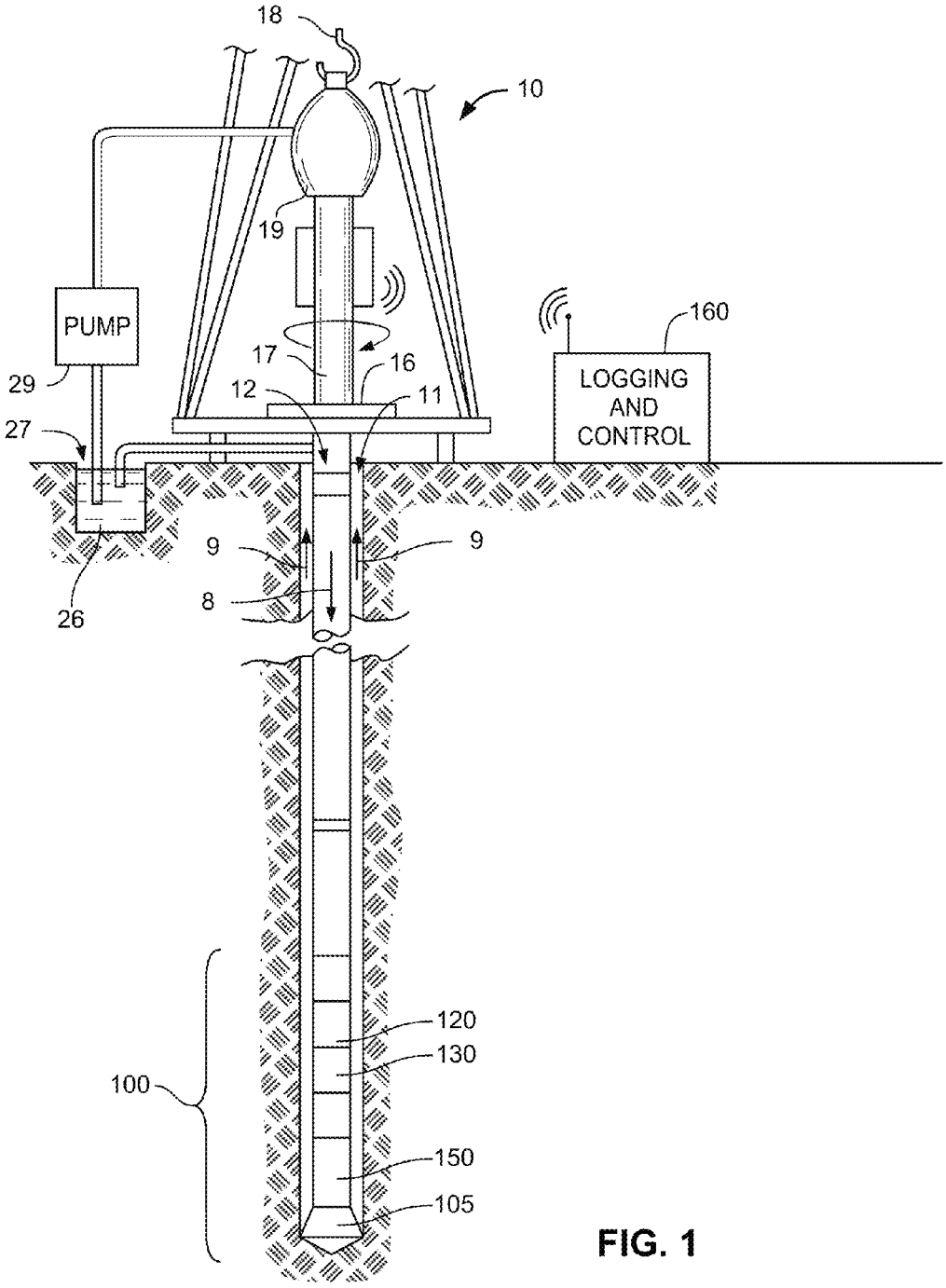
FIG. 1 depicts a schematic illustration of a wellsite system according to one or more aspects of the present disclosure.

It is to be understood that the following disclosure provides many different embodiments or examples for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Further, the formation of a first feature over or on a second feature in the description that follows may include embodiments in which the first and second features are formed in direct contact and may also include embodiments in which additional features may be formed between the first and second features such that the first and second features may not be in direct contact.

In general, the example methods and apparatus described herein provide an intuitive and fully integrated cleanup monitoring system that facilitates efficient cleanup and sampling operations of fluid being drawn into a downhole formation fluid sampling tool. More specifically, the example methods and apparatus provide a graphical user interface that enables an operator or user to graphically view cleanup progress during a sampling operation and predicted cleanup dynamics before initiating a cleanup/sampling operation and/or during a cleanup/sampling operation. The user may interact with the graphical user interface to input various parameter values associated with a fluid transport model. Thus, when using the graphical user interface in a job planning mode or a sensitivity analysis mode, these parameter values or ranges of values may be defined by the user to be representative or estimates of conditions associated with a particular wellbore and formation from which a sample fluid is to be obtained. The user may then interact with the graphical user interface to cause a processing unit to invoke the processing of the entered parameter values or ranges of values via a simulation engine employing a forward fluid transport model. The data output by the simulation engine may then be visually displayed via the user interface as one or more curves representing estimated or predicted cleanup characteristics for the cleanup scenario(s) defined by the user via the entered parameters. More specifically, curves depicting estimated contamination level versus pumpout volume for one or more viscosity ratios may be displayed. Additionally or alternatively, one or more curves depicting optical density versus pumpout volume may be displayed. In this manner, the user can quickly and easily gain an intuitive understanding of possible or probable cleanup behavior of a particular wellbore and formation prior to beginning any cleanup/sampling operation.

To enable substantially more rapid processing than many known approaches to sampling job planning, the simulation engine employed by the example methods and apparatus described herein uses data structure such as a lookup table containing processed numerical simulation data for the fluid flow and contamination transport model. In particular, the lookup table data is generated by performing multiple simulations in accordance with the fluid flow and contamination transport model for a wide range of possible values for the parameters of the model. For example, a predetermined input sensitivity range may be used to define the range of values used for each model parameter, thereby defining the extent of the numerical simulations to be performed. In operation, the processing of the parameter values input by the user in accordance with the fluid flow and contamination transport model may then be performed by obtaining or finding a forward solution via the lookup table. Such a solution may be found relatively quickly using approximation and/or interpolation or limited range extrapolation with respect to the processed numerical simulation data contained in the lookup table. In other words, forward solutions do not have to be found via further time-consuming simulations. Rather, the forward solutions can be found quickly via the previously generated and processed simulation data contained in the lookup table.

The graphical user interface of the example methods and apparatus described herein may also be used to predict the cleanup of a formation fluid based on one or more measured characteristics of the sample fluid collected relatively early in the cleanup operation. For example, the methods and apparatus described herein may enable a user to view measured optical density values of the fluid being drawn into the downhole tool as a graph, curve and/or data points displayed via the graphical user interface. By interacting with the graphical user interface, the user may then select a number of these displayed data points as fitting points as well as select a set of parameters of the fluid flow and contamination transport model to use as inversion parameters. Alternatively, the fitting points and/or the inversion parameters may be selected automatically (e.g., without user involvement). Regardless of whether the fitting points are user selected or automatically selected (e.g., by the processing unit), the fitting points may be selected from data points corresponding to measurements taken subsequent to the detection of the breakthrough of virgin formation fluid and/or the data points may be selected to be spaced relatively evenly with respect to the logarithm of pumpout volume.

Once the fitting points and the inversion parameters have been selected, the user may invoke (e.g., via the graphical user interface) an inversion process that is carried out by the processing unit executing an inversion engine. To perform the inversion, the inversion engine may employ a global optimization technique (e.g., the Shuffled Complex Evolution Method) that finds an optimal solution within the lookup table containing the processed numerical simulation data. Again, as with the forward solution approach noted above, the use of the lookup table in this manner enables the example methods and apparatus described herein to quickly find inversion solutions without having to conduct further time-consuming simulations involving the fluid flow and contamination transport model associated with the inversion parameters.

The optimal inversion solution provided by the inversion engine may then be visually depicted as one or more graphs or curves via the user interface. These graphs or curves may be displayed, for example, as a predicted optical density versus a pumpout volume and may be displayed along with any collected optical density measurements to provide the user an intuitive representation of the degree to which the predicted optical density curve fits the actual measured data. Further, the user may use the predicted optical density curve to estimate when an acceptable cleanup (e.g., an acceptable contamination level) of the sample fluid will likely be achieved, thereby greatly facilitating efficient allocation and use of resources, which may be particularly important in operations conducted on highly time-sensitive wellsites. For example, generally, the amount of time for which a drill string rotation may be halted is very limited. The predicted cleanup may, for example, be obtained in the form of a target pumpout volume at which an acceptable contamination level is predicted to be achieved. In this case, the cleanup operation may be terminated and fluid samples may be collected once the actual pumpout volume equals or exceeds the target pumpout volume. Further, to increase the accuracy of the predictions, the user may perform multiple, successive inversions and analyze (e.g., visually via the graphical user interface) corresponding successive predicted curves (e.g., optical density curves) to determine whether the cleanup predictions have converged. Once the cleanup predictions converge sufficiently, the user may reliably infer that the accuracy of the prediction has been optimized under the fluid flow and contamination transport model being used.

Using the above-described approach to predict the cleanup of a sample fluid enables accurate predictions of sample fluid contamination levels or cleanup to be made at pumpout volumes that are, for example, five to ten times smaller than the final (i.e., target) pumpout volume. As a result, accurate cleanup predictions can be made relatively early during a cleanup operation. For example, the example methods and apparatus described herein may enable accurate cleanup predictions to be made substantially (e.g., five to seven times) earlier than possible with many known techniques.

As will be evident from the following description, one or more aspects of the present disclosure relate to methods and apparatus to enable efficient job planning, sensitivity analysis and/or cleanup monitoring and prediction. Further, while the examples described below are directed to the use of optical monitoring data (e.g., optical density data), the methods and apparatus described herein may be more generally or differently applied. For instance, the methods and apparatus described herein may be similarly applicable to estimate other fluid characteristics and/or parameters such as fluid density, gas-oil-ratio (GOR), compressibility, bubble point pressure, etc.

FIG. 1 depicts a wellsite system including component(s) that may be utilized to monitor and/or predict cleanup during formation sampling or prior thereto according to one or more aspects of the present disclosure. The wellsite drilling system of FIG. 1 can be employed onshore and/or offshore. In the example wellsite system of FIG. 1, a borehole 11 is formed in one or more subsurface formations by rotary and/or directional drilling.

As illustrated in FIG. 1, a drill string 12 is suspended in the borehole 11 and includes a bottom hole assembly (BHA) 100 having a drill bit 105 at its lower end. A surface system includes a platform and derrick assembly 10 positioned over the borehole 11. The derrick assembly 10 includes a rotary table 16, a kelly 17, a hook 18 and a rotary swivel 19. The drill string 12 is rotated by the rotary table 16, energized by means not shown, which engages the kelly 17 at an upper end of the drill string 12. The example drill string 12 is suspended from the hook 18, which is attached to a traveling block (not shown), and through the kelly 17 and the rotary swivel 19, which permits rotation of the drill string 12 relative to the hook 18. Additionally, or alternatively, a top drive system could be used.

In the example depicted in FIG. 1, the surface system further includes drilling fluid 26, which is commonly referred to in the industry as mud, and which is stored in a pit 27 formed at the well site. A pump 29 delivers the drilling fluid 26 to the interior of the drill string 12 via a port in the rotary swivel 19, causing the drilling fluid 26 to flow downwardly through the drill string 12 as indicated by the directional arrow 8. The drilling fluid 26 exits the drill string 12 via ports in the drill bit 105, and then circulates upwardly through the annulus region between the outside of the drill string 12 and the wall of the borehole 11, as indicated by directional arrows 9. The drilling fluid 26 lubricates the drill bit 105, carries formation cuttings up to the surface as it is returned to the pit 27 for recirculation, and creates a mudcake layer (not shown) on the walls of the borehole 11.

The example bottom hole assembly 100 of FIG. 1 includes, among other things, any number and/or type(s) of logging-while-drilling (LWD) modules or tools (one of which is designated by reference numeral 120) and/or measuring-while-drilling (MWD) modules (one of which is designated by reference numeral 130), a rotary-steerable system or mud motor 150 and the example drill bit 105. The MWD module 130 measures the drill bit 105 azimuth and inclination that may be used to monitor the borehole trajectory.

The example LWD tool 120 and/or the example MWD module 130 of FIG. 1 may be housed in a special type of drill collar, as it is known in the art, and contains any number of logging tools and/or fluid sampling devices. The example LWD tool 120 includes capabilities for measuring, processing and/or storing information, as well as for communicating with the MWD module 130 and/or directly with the surface equipment, such as, for example, a logging and control computer 160.

The logging and control computer 160 may include or be in communication with a user interface, such as a graphical user interface (GUI), that enables display and/or input of fluid flow and contamination transport model parameters and/or display of other inputs or outputs associated with the drilling operation and/or the formation traversed by the borehole 11. For example, the logging and control computer 160 may communicate measurements made via one or more of the tools 120 and 130 to a processing unit, which may be part of or separate from the logging and control computer 160. As described in greater detail below, the processing unit may receive fitting parameters or points and one or more inversion parameters, one or both of which may be used by the processing unit to perform an inversion to generate data associated with predicted cleanup of fluid samples. While the logging and control computer 160 is depicted uphole and adjacent the wellsite system, a portion or all of the logging and control computer 160 may be positioned in the bottom hole assembly 100 and/or in a remote location.

Figure 2:
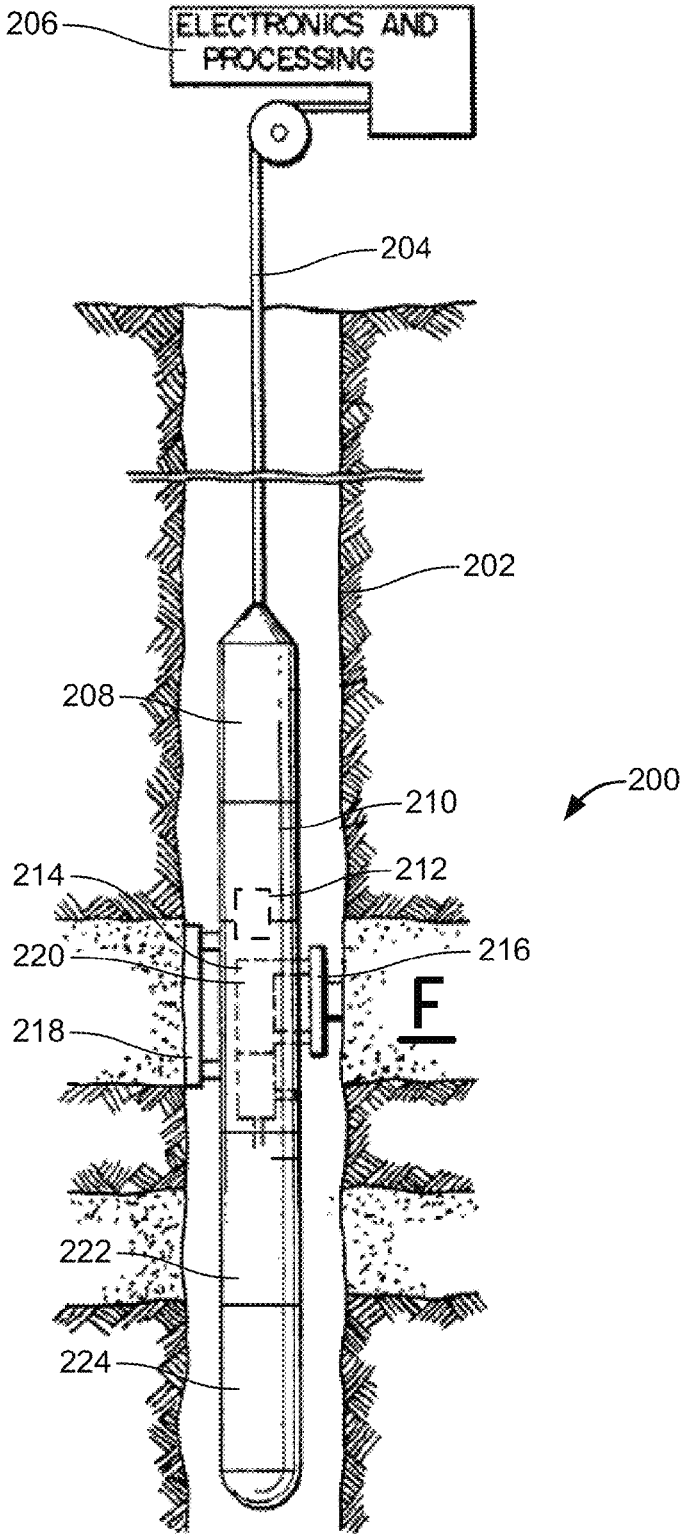
FIG. 2 is a schematic illustration of a wireline-deployed downhole tool or toolstring according to one or more aspects of the present disclosure.

FIG. 2 depicts an example wireline system or tool 200 including component(s) that may be utilized to predict cleanup during formation sampling or prior thereto according to one or more aspects of the present disclosure. The example wireline tool 200 may be used to extract and analyze formation fluid samples and is suspended in a borehole or wellbore 202 from the lower end of a multiconductor cable 204 that is spooled on a winch (not shown) at the surface. At the surface, the cable 204 is communicatively coupled to an electrical control and data acquisition system 206. The electrical control and data acquisition system 206 and/or a processing unit (e.g., similar to the processing unit P100 of FIG. 33) may receive one or more inputs and generate one or more outputs. For example, the electrical control and data acquisition system 206 may receive one or more measured optical density values (e.g., fitting points) and one or more inversion parameters one or both of which may be used in an inversion performed at least partially by the electrical control and data acquisition system 206 to generate data associated with predicted cleanup of fluid samples. The generated data may enable predictions of cleanup production to be established by plotting predicted contamination versus pumpout volume, for example.

The wireline tool 200 has an elongated body 208 that includes a collar 210 having a tool or downhole control system 212 configured to control extraction of formation fluid from a formation F and measurements performed on the extracted fluid. The wireline tool 200 also includes a formation tester 214 having a selectively extendable fluid admitting assembly 216 and a selectively extendable tool anchoring member 218 that are respectively arranged on opposite sides of the body 208. The fluid admitting assembly 216 is configured to selectively seal off or isolate selected portions of the wall of the wellbore 202 to fluidly couple to the adjacent formation F and draw fluid samples from the formation F. The formation tester 214 also includes a fluid analysis module 220 through which the obtained fluid samples flow. The fluid may thereafter be expelled through a port (not shown) or it may be sent to one or more fluid collecting chambers 222 and 224, which may receive and retain the formation fluid for subsequent testing at the surface or a testing facility.

In the illustrated example, the electrical control and data acquisition system 206 and/or the downhole control system 212 are configured to control the fluid admitting assembly 216 to draw fluid samples from the formation F and to control the fluid analysis module 220 to measure the fluid samples. In some example implementations, the fluid analysis module 220 may be configured to analyze the measurement data of the fluid samples as described herein. In other example implementations, the fluid analysis module 220 may be configured to generate and store the measurement data and subsequently communicate the measurement data to the surface for analysis as described herein. Although the downhole control system 212 is shown as being implemented separate from the formation tester 214, in some example implementations, the downhole control system. 212 may be implemented in the formation tester 214.

One or more modules or tools of the example drill string 12 and/or the logging and control computer 160 shown in FIG. 1 and/or the example wireline tool 200 and/or the electrical control and data acquisition system 206 of FIG. 2 may employ the example methods and apparatus described herein to obtain measurements of fluid samples and utilize at least some of these measurements in conjunction with other parameters and/or data to monitor and/or predict cleanup of sample fluid extracted from a formation. For example, one or more of the LWD tool 120 (FIG. 1), the MWD module 130 (FIG. 1), the logging and control computer 160 (FIG. 1), the downhole control system 212 (FIG. 2), the formation tester 214 (FIG. 2) and/or the electrical control and data acquisition system 206 (FIG. 2) may utilize the example methods and apparatus described herein. While the example apparatus and methods described herein are described in the context of drill strings and/or wireline tools, they are also applicable to any number and/or type(s) of additional and/or alternative downhole tools such as coiled tubing deployed tools.

Figure 3:
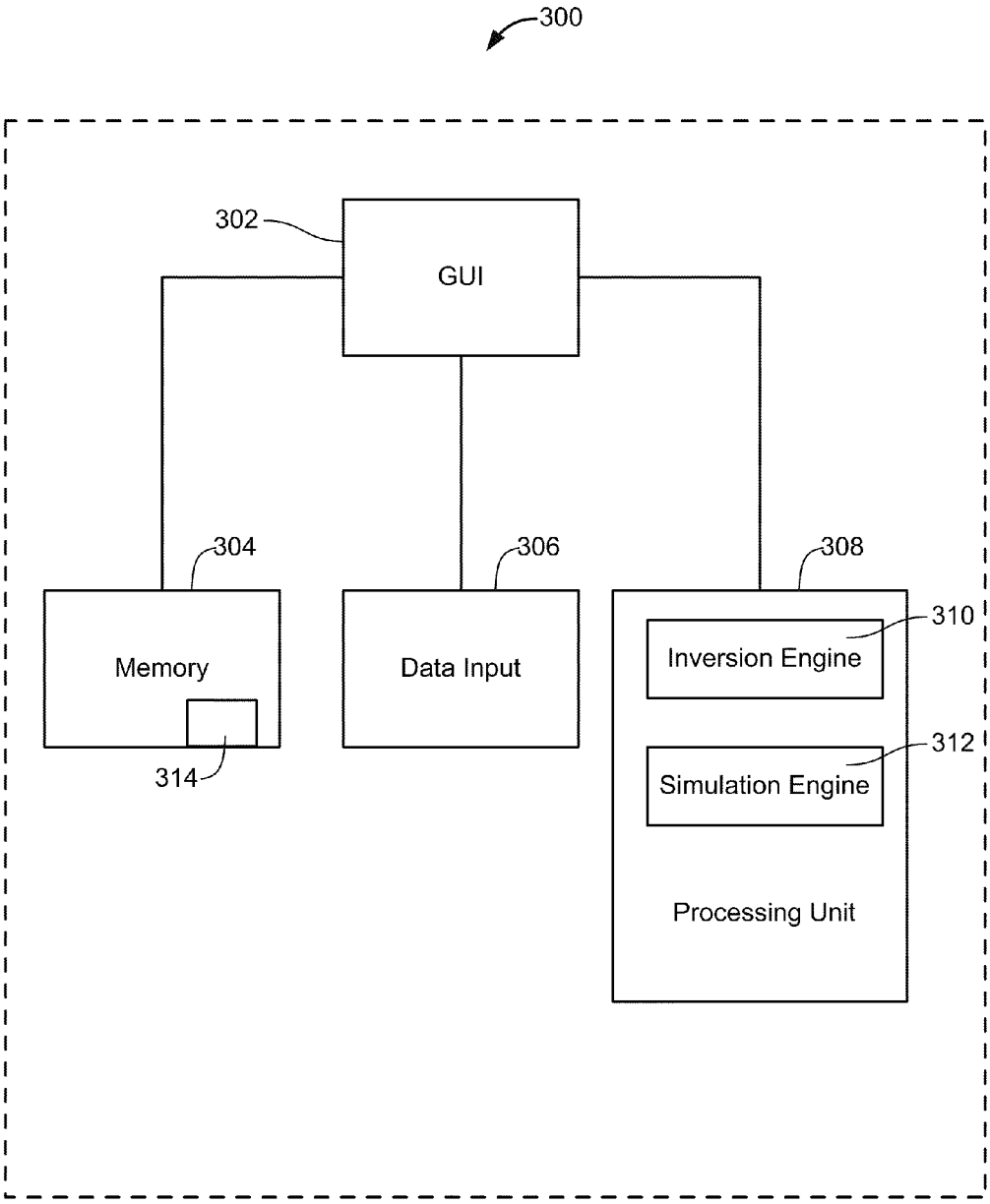
FIG. 3 is a schematic block diagram according to one or more aspects of the present disclosure.

FIG. 3 depicts an example system or apparatus 300 that may be used to monitor and/or predict cleanup in connection with a downhole sampling operation. As described in greater detail below, the example apparatus 300 may be configured to use processed numerical simulation data associated with a fluid flow and contamination transport model and stored in a lookup table to facilitate relatively rapid estimation or prediction of sample fluid cleanup prior to initiating a sampling operation and/or during the sampling operation.

In one aspect, the example apparatus 300 enables implementation of a forward model via the lookup table to simulate various sample cleanup scenarios as defined by parameter values entered via a graphical user interface by an operator or user. Such forward-based simulation allows the user to interact with the example apparatus 300 to efficiently perform sampling job planning, sensitivity analysis and/or cleanup dynamics prediction, for example.

In another aspect, the example apparatus 300 enables implementation of an inversion process via the lookup table. Such an inversion process can be employed during a cleanup operation to facilitate, for example, an early, accurate prediction of the pumpout volume at which a target or sufficiently low level of sample contamination will be achieved. Specifically, the inversion process can use measurements (e.g., optical density values) collected during the early phases of the cleanup operation (e.g., beginning after first virgin formation fluid breakthrough has been detected) as fitting points, for which a solution to the fluid flow and contamination transport model is found via interpolation and/or approximation relative to the data stored in the lookup table. A user may interact with the graphical user interface to select the fitting points and/or to view one or more graphs depicting cleanup-related predictions, measured data, modeling parameters and values, etc.

Further, the example apparatus 300 may be implemented in any of the apparatus described herein and may be at least partially coded for a Matlab platform or any other desired software platform. For example, the apparatus 300 may be at least partially implemented in the logging and control computer 160 (FIG. 1) and/or the electrical control and data acquisition system 206 (FIG. 2).

Now turning in detail to FIG. 3, the example apparatus 300 includes a graphical user interface (GUI) 302, a memory 304, a data input 306 and a processing unit 308. The processing unit 308 implements an inversion engine 310 and a simulation engine 312. While the inversion engine 310 and the simulation engine 312 are depicted in this example as being implemented by the processing unit 308, the engines 310 and 312 could, instead, be implemented via separate respective processing units. Further, one or more of the blocks 302-312 of the example system 300 may be implemented using any desired combination of software and/or hardware. Software may include any computer readable and executable instructions or code stored temporarily, semi-permanently or permanently on a tangible computer readable medium such as, for example, a compact disc, a digital versatile disc, a random access memory, a read only memory, or any other medium. Hardware may include any combination of discrete electronic devices, integrated circuits, application specific integrated circuits, etc.

The GUI 302 may be implemented using a video display terminal having a touch pad/screen. The GUI 302 may be integrated with and/or in communication with the logging and control computer 160 (FIG. 1) and/or the electrical control and data acquisition system 206 (FIG. 2), for example. In operation, the GUI 302 may enable parameters and/or parameter values to be input and/or data to be displayed. For example, the GUI 302 may display graphs of optical monitoring data, graphs of computed/predicted optical densities versus pumpout volume, inversion parameters, inversion options (e.g., the parameters to be inverted), graphs of contamination versus pumpout volume, etc. A more detailed description of example manners in which the GUI 302 may be implemented is provided below in connection with FIGS. 14-17 and 22-25.

The memory 304 may be implemented using any type of computer readable storage medium that stores data such as measurement or monitoring data, simulation data and/or a lookup table generated using numerical modeling simulations. The stored data may be obtained and/or generated using the example methods and apparatus described herein. In operation, the processing unit 308 may obtain stored data (e.g., data from the lookup table containing processed numerical simulation data associated with a fluid flow and contamination transport model) for use by the simulation engine 312 and/or the inversion engine 310. Similarly, in operation, the processing unit 308 may store data such as predicted or estimated cleanup data generated by the simulation engine 312 and/or the inversion engine 310 in the memory 304.

The data input 306 may be a keyboard, mouse, track ball, microphone, etc. enabling data such as inversion parameters and/or optical monitoring data to be selected and/or input into the apparatus 300. The data input 306 may be incorporated into the GUI 302.

In contrast to many known fluid flow and transport simulation techniques, the simulation engine 312 enables virtually real-time processing of fluid flow and contamination transport model parameter values to generate predicted cleanup dynamics. In particular, the simulation engine 312 employs a lookup table 314 containing the processed results of numerous simulations for an anticipated range (e.g., a predetermined sensitivity range) of model parameter values. In other words, many time-consuming simulations are performed and the processed results of these simulations are stored in a data structure such as a lookup table for quick reference by the simulation engine 312 during a sampling planning operation. While the lookup table data 314 is depicted as being stored in the memory 304, the lookup table data 314 could be stored in any other location that is accessible by the processing unit 308, the simulation engine 312 and/or the inversion engine 310.

In contrast to many known modeling approaches, the modeling approach used to generate the lookup table data 314 does not attempt to predict or evaluate drilling, filtrate invasion or mudcake buildup during mud circulation (or without mud circulation). Such known modeling approaches involve a substantial amount of uncertainty and, typically require substantial effort in connection with calibrating the parameters associated with a mudcake buildup model. Rather than attempting to model mudcake buildup and oil-based-mud (OBM) filtrate invasion, the modeling approach used to generate the lookup table data 314 assumes the depth of mud filtrate invasion is unknown and, thus, may be determined via an inversion process based on collected or measured data as described in greater detail below. Thus, the modeling approach used to generate the lookup table data 314 uses simulations of flow and contamination transport from a formation to a sampling probe of a formation tester for a wide range of mud filtrate invasion depths and viscosity contrast levels that are likely to be present at the beginning of a sampling operation (i.e., after drilling, filtrate invasion and mudcake buildup have occurred).

The model used in the modeling approach may be selected to reduce the number of input parameters. In one example, the model selected may be based on a sampling operation in which fluid is extracted in a single phase assuming a piston-like displacement with viscosity contrast. Such a model involves parameters including depth of mud filtrate invasion, viscosity ratio, permeability anisotropy ratio, borehole radius, formation thickness, and porosity. Further, the simulations of the model used to generate the lookup table data 314 are based on an assumed axisymmetrical invasion zone surrounding a vertical borehole and producing fluid through a probe located at the borehole wall in the middle of the formation thickness. The effects of dispersion in the porous media of the formation and hydrodynamic instability (fingering) are neglected.

A more detailed discussion of the manner in which the simulations and the processing of the results of those simulations are used to generate the lookup table data 314 may be performed is provided below in connection with FIGS. 4-13. However, generally, the results of the simulations are processed using a dimensional analysis that produces a solution of the contamination transport problem that equates contamination (η) to a function of the normalized pumpout volume (Ω), the depth of invasion scaled over the wellbore radius (δ), viscosity ratio (μ) and formation thickness divided by the wellbore diameter (H) as shown below in Equation 1.

$$\eta = F(\Omega.\delta.\mu.H) \qquad \text{Equations 1}$$

$$\Omega = \frac{V_P}{V_{BT}}.$$

$$\delta = \frac{d_i}{r_w}.$$

$$\mu = \frac{\mu_{Oil}}{\mu_{Filmfate}}.$$

$$H = \frac{h}{2r_w}$$

$$V_{BT} = V_0 G(\delta.\mu.H).$$

$$V_0 = \varphi r_w^3 \left(\frac{k_V}{k_H}\right)^{1/2}$$

The lookup table data 314 may be generated using Equations 1. In operation, the simulation engine 312 may receive one or more parameter values via the graphical user interface 302 and/or the data input 306, in response to user interaction with the same, and process the parameter values (e.g., using interpolation and/or approximation) in conjunction with the lookup table data 314 to determine a forward solution to the fluid flow and contamination transport model. The parameter values input by the user may be input prior to the initiation of any sampling operation and may be representative of anticipated parameter values for the formation to be sampled. The user may interact with the graphical user interface 302 and the data input 306 to input multiple sets of parameter values representing multiple sampling scenarios to facilitate job planning activities, sensitivity analyses, etc. Each of the sampling scenarios evaluated by the user may also be visually depicted as a graph or graphs via the GUI 302 to provide the user with an intuitive understanding of the predicted sampling process(es).

The inversion engine 310 may be used to accurately predict cleanup of a fluid sample based on monitoring or measurement data collected during, for example, the early phases of a sampling operation. In general, the inversion engine 310 may reconstruct the global behavior of optical density measured during cleanup production monitoring by treating input data to the simulation engine 312 as fitting parameters. More specifically, the inversion engine 310 may reconstruct flow and contamination transport patterns by inverting one or more fitting points, which may be associated with cleanup monitoring data and/or optical monitoring data such as optical densities of sample fluid drawn from the formation. The optical densities may have been measured at different times subsequent to detecting a breakthrough of formation fluid and these different times may be spaced substantially equally relative to a logarithm of pumpout volume of fluid from the formation. The inversion engine 310 is configured to enable inversion of measured optical density values with respect to the depth of mud filtrate invasion (4), viscosity ratio ($\mu=\mu_{oil}/\mu_{filtrate}$), formation thickness (h), and/or optical density of the formation fluid ($OD_{oil}$) and optical density of the oil-based-mud filtrate ($OD_{filtrate}$). The optical density of a mixture of OBM and oil or formation fluid can be expressed as shown below in Equation 2.

$$OD=\eta\times OD_{Filtrate}+(1-\eta)\times OD_{Oil} \qquad \text{Equation 2}$$

The inversion engine 310 uses Equations 1 and 2 above to calculate optical density of a mixture as a function of pumpout volume $OD(V_p)$. This calculated optical density is compared to the measured optical densities (e.g., the optical density fitting points) $OD_M(V_p)$ and the difference between the measured and calculated optical density functions is minimized by adjusting the inversion parameters ($d_i$, μ, h, $OD_{oil}$, $OD_{filtrate}$). This minimization can be expressed as an objective function R(.) as shown below in Equation 3.

$$\min_{\{d_i.\mu.h.OD_{oil}.OD_{filtrate}\}} R(\cdot), \quad R(\cdot) = \int_{V_{BT}}^{V_P} \|OD - OD_M\| dV_P \qquad \text{Equation 3}$$

The inversion engine 310 may perform the minimization of the objective function shown in Equation 3 using a global optimization technique commonly referred to as the Differential Evolution Method, for example, the Shuffled Complex Evolution Method (SCE-UA), which combines both probabilistic and deterministic approaches. In general, use of the SCE-UA by the inversion engine 310 is based on a systematic evolution of the complexes of points representing the unknown parameters ($d_i$, μ, h, $OD_{oil}$, $OD_{filtrate}$) spanning the entire parameter space. The competitive evolution method employed by the SCE-UA is governed by the downhill simplex method featuring simplex reflection, expansion, contraction, shrinking and mutation for points within each complex. Repeated shuffling of all points between complexes may help to avoid or prevent sticking to local minima of the objection function in Equation 3.

While the inversion engine 310 is configured to enable inversion using all of the parameters ($d_i$, μ, h, $OD_{oil}$, $OD_{filtrate}$), the inversion engine 310 can perform the inversion using a subset of these parameters. In particular, if some of the inversion parameters are known and/or may be reasonably estimated, the inversion engine 310 may perform an inversion with respect to a subset of the inversion parameters that are not known and/or which cannot be reasonably estimated. For example, if the depth of mud filtrate invasion is known and the viscosity ratio, the optical density of formation fluid and the optical density of oil-based mud filtrate are unknown, the inversion engine 310 may perform an inversion with respect to those unknown parameters. In practice, the optical density of the oil-based mud filtrate may be approximately 0.1 and the viscosity ratio may be previously determined from offset wells, for example, thereby enabling a user to consider these parameter values as known values to simplify the inversion process. As described in more detail below, the GUI 302 enables selection of different options and/or combinations of inversion parameters to be determined, predicted and/or found during inversion. Further, other inversion parameters such as, porosity and/or permeability anisotropy ratio could be included. However, these parameters may trigger non-uniqueness of inversion and, thus, have been omitted from the example provided for purposes of explaining the basic operation of the inversion engine 310.

In practice, because the inversion engine 310 uses a discrete number of measured optical density values, the objective function of Equation 3 may be implemented by replacing the integral (a continuous function operator) with a sum of residuals calculated for selected values of pumpout volume (Vp) distributed over the monitoring interval. However, the number of fitting points should be greater than the number of inversion parameters used. For example, if there are five inversion parameters, the number of fitting points may be equal to or greater than six.

The optical densities used as fitting points may be selected manually (e.g., by a user pointing via mouse or the like and clicking on the points) using the GUI 302. The selected optical densities may be distributed substantially uniformly over a monitoring range of pumpout volume such as less than 15% to 20% of the total pumpout volume, for example. Additionally or alternatively, the optical densities used as fitting points may be selected automatically by running optical monitoring data through a low-pass filter and then distributing an allocated number of points uniformly along a pumpout volume axis in logarithmic scale.

The measured optical density values may be compared to values of the lookup table data 314 within an investigated range of inversion parameters to fit the measured values to the appropriate solution of the forward solution of the fluid flow and contamination transport model. The lookup table data 314 may enable efficient sensitivity analysis with respect to unknown parameters such as depth of invasion, viscosity contrast and/or permeability anisotropy.

Based on the inversion and, specifically, the predicted inversion parameters in conjunction with the lookup table data 314, the appropriate solution of the forward model may be determined and/or the optical densities versus the pumpout volume may be predicted by the inversion engine 310. These computed values may be plotted via the GUI 302 adjacent to and/or on top of the optical monitoring data to enable an intuitive visual comparison to be conducted.

The inversion process may be conducted repeatedly in a time lapse or successive manner based on evolving optical monitoring data to enable predictions generated by the inversion engine 310 to more closely resemble the optical monitoring data, to enable the predictions to stabilize and/or to enable the predictability of cleanup production to be established. Once the predictability of cleanup production has been established, the pumpout volume versus the sample contamination and/or the time on station versus the sample contamination may be established by the simulation engine 312, for example. In contrast to many known techniques, these predictions may be established using relatively early segments of optical density logs.

After an inversion has taken place, the simulation engine 312 may be used in connection with the lookup table 314 to predict a time on station versus the sample contamination targets based on the determined and/or adjusted inversion parameters, enabling evaluation of forward problems in substantially real-time. The inversion parameters may be compared to scenarios in the lookup table by the simulation engine 312 to predict the solution to the forward model, for example. The input parameters may include OBM filtrate invasion, formation fluid mobility, viscosity contrast, permeability anisotropy ratio, etc.

Figure 4:
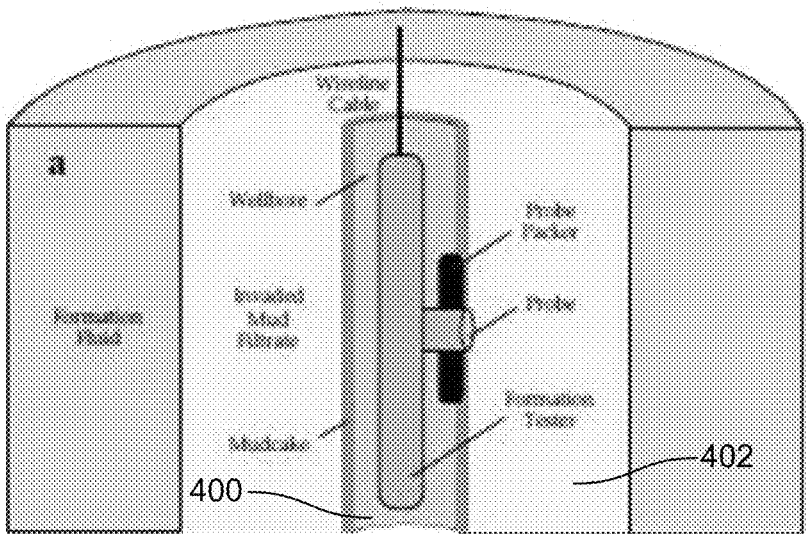
FIGS. 4-5 depict simulated fluid flow and contamination transport patterns according to one or more aspects of the present disclosure.
Figure 5:
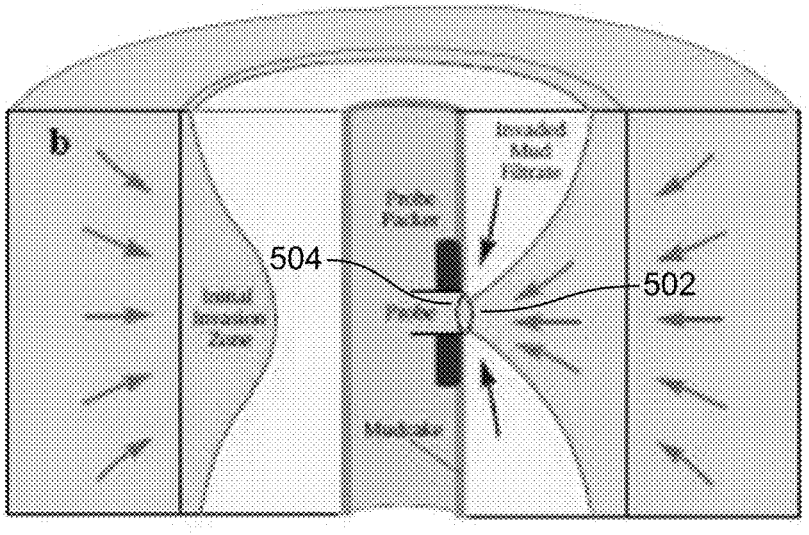
Figure 6:
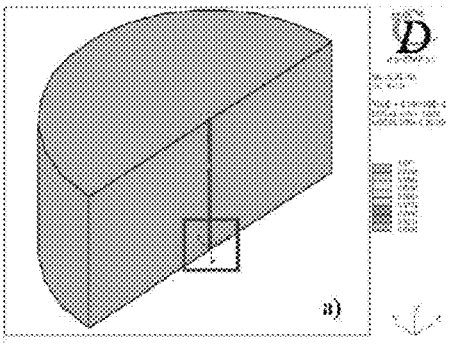
FIGS. 6-9 depict detailed simulated fluid flow and contamination transport patterns according to one or more aspects of the present disclosure.
Figure 7:
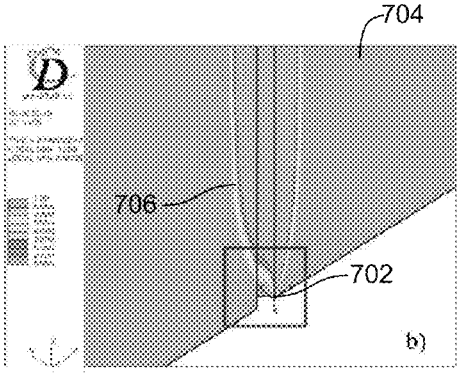
Figure 8:
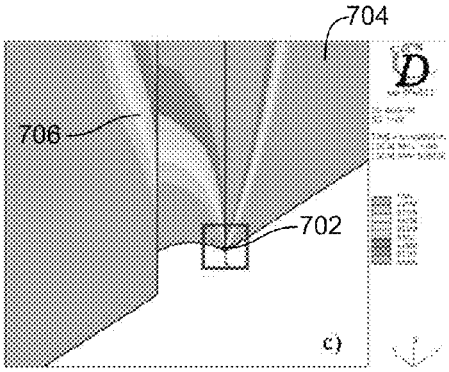
Figure 9:
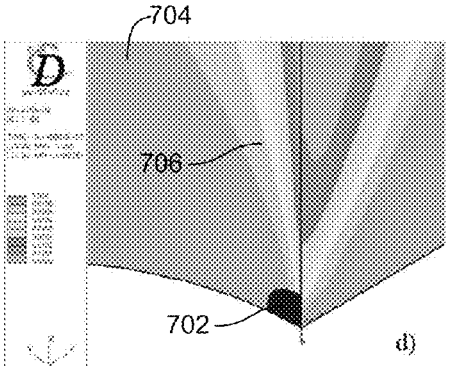

FIGS. 4 and 5 depict simulated flow and contamination transport patterns. FIG. 4 depicts the initial geometry of a wellbore 400 surrounded by an invasion zone 402 saturated with OBM filtrate. Initially, fluid drawn from the formation may include a substantial amount of OBM filtrate (e.g., a relatively high level of contamination). However, as depicted in FIG. 5, a breakthrough of virgin formation fluid 502 to a probe production area 504 occurs in time as fluid is drawn from the formation. The contamination of formation fluid by the OBM filtrate usually decreases relatively rapidly just after the breakthrough of the virgin formation fluid but, thereafter, the rate at which the contamination of the formation fluid decreases may be slower. This decrease in contamination cleanup rate may result in relatively large cleanup production volumes (e.g., relatively large amounts of pumpout volume) to reach a target contamination level in the drawn formation fluid (e.g., a relatively low level of contamination).

FIGS. 6-9 depict a simulated flow and contamination transport pattern progressively enlarged. Reference number 702 represents the probe production area, reference number 704 represents virgin formation fluid and reference number 706 represents a contamination boundary affected by numerical dispersion.

The simulations of flow and transport during cleanup production of FIGS. 6-9 represent one quarter of the reservoir volume surrounding the borehole with a probe production area. The simulation domain was bounded by the two planes of symmetry, the wellbore wall covered by mudcake and the two far field boundaries. The flow and contamination transport in reservoir during cleanup production was simulated using a single-phase two-component model of flow in porous medium governed by Darcy's law assuming full miscibility of OBM filtrate with a virgin hydrocarbon formation fluid. The dispersion in porous medium induced by the tortuosity of pore channels was neglected assuming the piston-like displacement preserves sharp boundaries between fluids. The mobility contrast is controlled by the ratio of fluid viscosities. The effects of compressibility and volumetric changes, which may be pronounced during fluid mixing, have been neglected.

The simulations of cleanup production of FIGS. 6-9 represent a vertical well in a formation having a permeability anisotropy represented by the ratio of vertical and horizontal permeabilities $k_a=k_v/k_H$. The depth of mud filtrate invasion ($d_i$) varied from 0 to 40 inches and the viscosity contrast represented by the viscosity ratio ($\mu=\mu_{Oil}/\mu_{Filtrate}$) varied from 0.02 to 100. The far field boundaries were chosen at a distance of approximately 10 meters for $k_a=1$ to simulate the worst case scenario with unrestricted mud filtrate transport along the wellbore.

Figures 10, 11, 12:
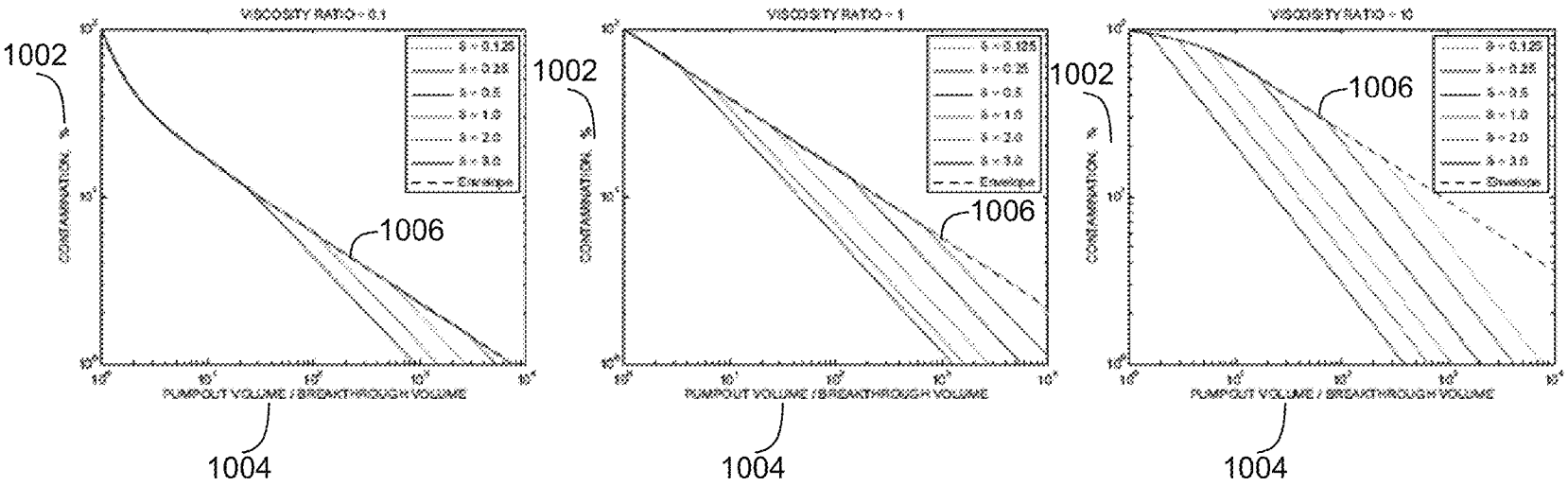
FIGS. 10-12 are example graphs according to one or more aspects of the present disclosure.

FIGS. 10-12 depict dynamics of cleanup production under a viscosity contrast ($\mu$) of 0.1, 1.0, and 10, respectively, for different depths of invasion scaled over the wellbore radius ($\delta=d_i/r_i$). The y-axis 1002 of FIGS. 10-12 corresponds to the concentration of mud filtrate in the produced fluid (contamination %) and the x-axis 1004 of FIGS. 10-12 corresponds to the pumpout volume divided by the breakthrough volume. The results were plotted for different depths of invasion scaled over the wellbore radius ($\delta=d_i/r_i$) versus the normalized pumpout volume ($\Omega=V_p/V_{BT}$). The dimensionless parameters of viscosity contrast ($\mu$) and the depth of invasion scaled over the wellbore radius ($\delta=d_i/r_i$) substantially affect the behavior of the fluid and, thus, provide a foundation for inversion. As shown, in the early phase of cleanup, the contamination curves are similar (e.g., collapse together). However, these contamination curves split during later phases of cleanup production providing resolution of the forward problem solution with respect to the dimensionless depth of invasion ($\delta$). The envelopes 1006 created by the contamination curves correspond to the solutions at the limit of disappearing depth of invasion $\delta\rightarrow 0$. To enable convenient approximation, the smooth transitions from the envelopes 1006 have been replaced with angular points.

Figure 13:
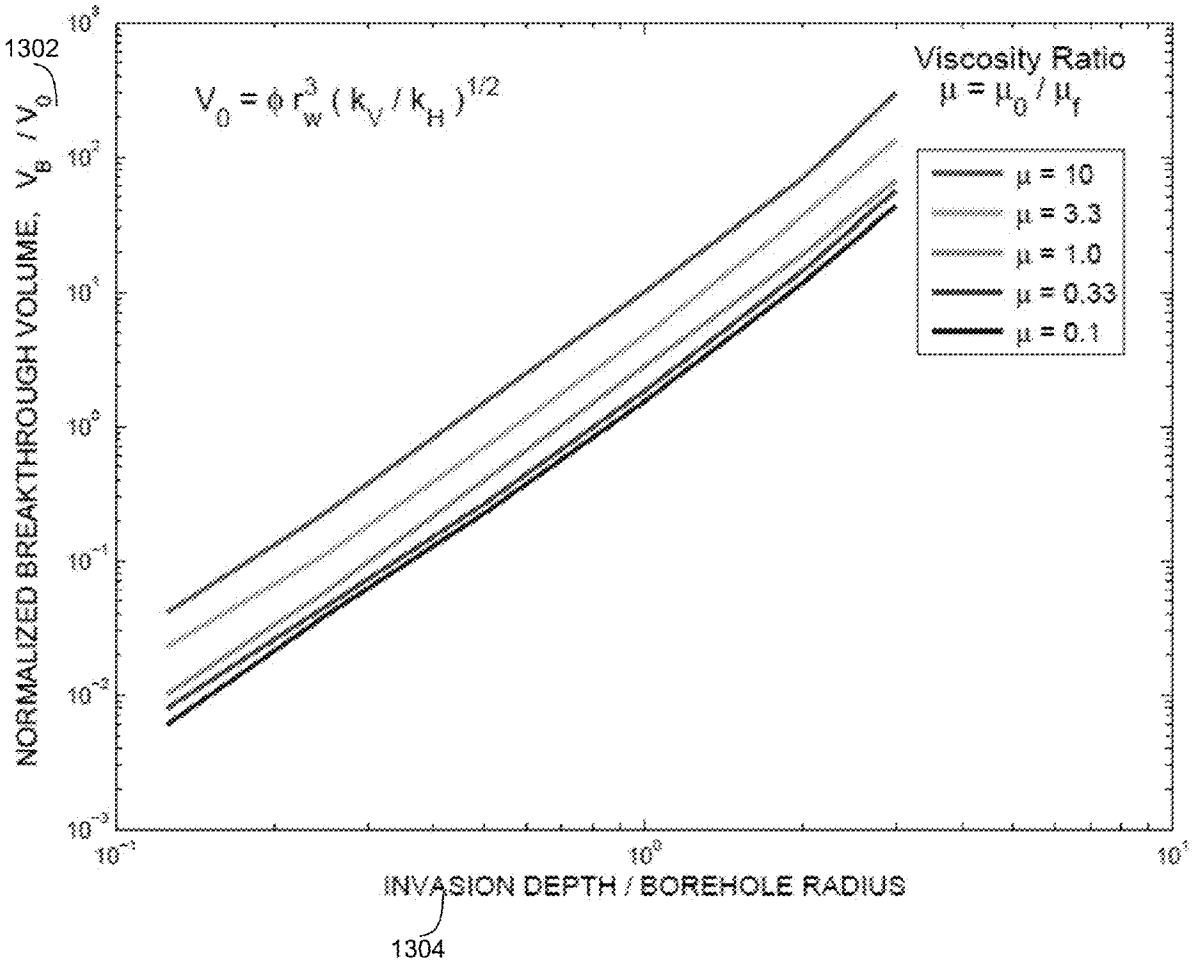
FIG. 13 is an example graph according to one or more aspects of the present disclosure.

FIG. 13 depicts the function $G(\delta, \mu, H)$ of Equations 1 above for a relatively thick formation for different viscosity contrasts ($\mu$). The y-axis 1302 of FIG. 13 corresponds to the normalized breakthrough volume ($V_B/V_0$) and the x-axis 1304 of FIG. 13 corresponds to the depth of invasion ($\delta$). As shown, the normalized breakthrough volume is affected by the depth of invasion but is less dependent on the viscosity ratio at least when the viscosity ratio is relatively low. The effect of formation thickness may be neglected except for relatively thin formations (H<1).

Figure 14:
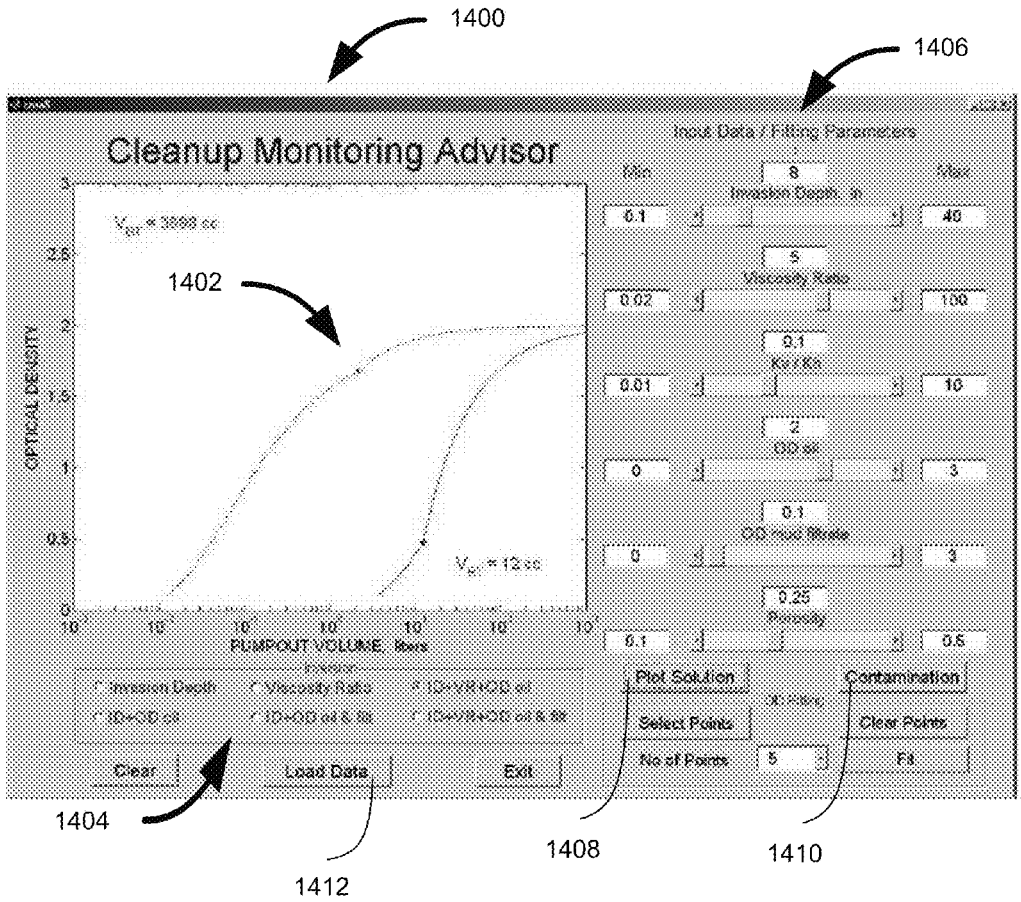
FIGS. 14-17 are example graphical user interfaces according to one or more aspects of the present disclosure.

FIG. 14 corresponds to an example graphical user interface (GUI) 1400 according to one or more aspects of the present disclosure. The GUI 1400 may be used to implement the GUI 302 (FIG. 3). At 1402, the GUI 1400 enables optical monitoring data, predicted optical densities versus pumpout volume, etc. to be displayed, graphed and/or plotted. At 1404, the GUI 1400 enables inversion options to be selected and/or identified. The inversion options include different sets of inversion parameters such as, invasion depth; invasion depth+optical density of the oil; viscosity ratio; invasion depth+optical density of the oil+optical density of the filtrate; invasion depth+viscosity ratio+optical density of the oil; and/or invasion depth+viscosity ratio+optical density of the oil+optical density of the filtrate. However, other or additional options and/or scenarios may be provided instead. At 1406, the GUI 1400 enables one or more inversion parameters to be input and/or enables the one or more inversion parameters to be displayed once predicted, generated and/or modified.

Figure 15:
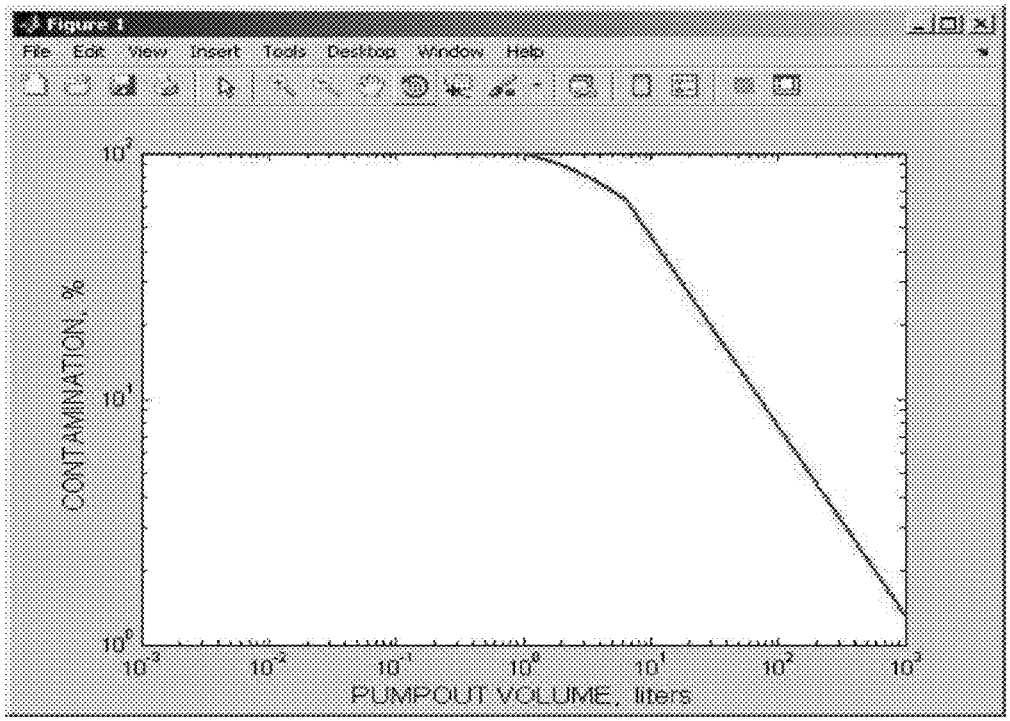

The GUI 1400 may enable a person to change the inversion parameters to analyze the sensitivity of the time on station versus the sample contamination and/or enables sampling job planning. For example, by entering inversion parameters at 1406 and selecting "Plot Solution" 1408, the computed, determined and/or predicted optical density may be expressed through the contamination of the produced fluid ($\eta$) and the optical densities of the mud filtrate ($OD_{Filtrate}$) and the formation oil ($OD_{Oil}$) at 1402. The optical densities of the mud filtrate and the formation oil may be at least initially unknown and, thus, may be input into the GUI 1400 prior to selecting "Plot Solution" 1408. By changing one or more of the inversion parameters, different solutions may be plotted at 1402 while still displaying the previous solution(s). The different solutions displayed at 1402 may be differentiated by color, line weight, line type, etc. By selecting "Contamination" 1410, the contamination versus pumpout volume may be plotted as depicted in FIG. 15. The predicted contamination versus pumpout volume may be at least partially based on the inversion parameters.

By selecting "Load Data" 1412, the GUI 1400 and/or another window may prompt a person to select a data file in, for example, ASCII format with the extension ".dat." However, any other data format may be used. Generally, the data file may include optical monitoring data including two columns, one corresponding to pumpout volume (e.g., in liters) and the other column corresponding to the optical densities of the produced fluid (e.g., the fluid being sampled). The optical densities may be filtered, the base channel may be removed and/or one of the optical densities channels less than 2.5 at the final phase may be subtracted to reduce noise.

Figure 16:
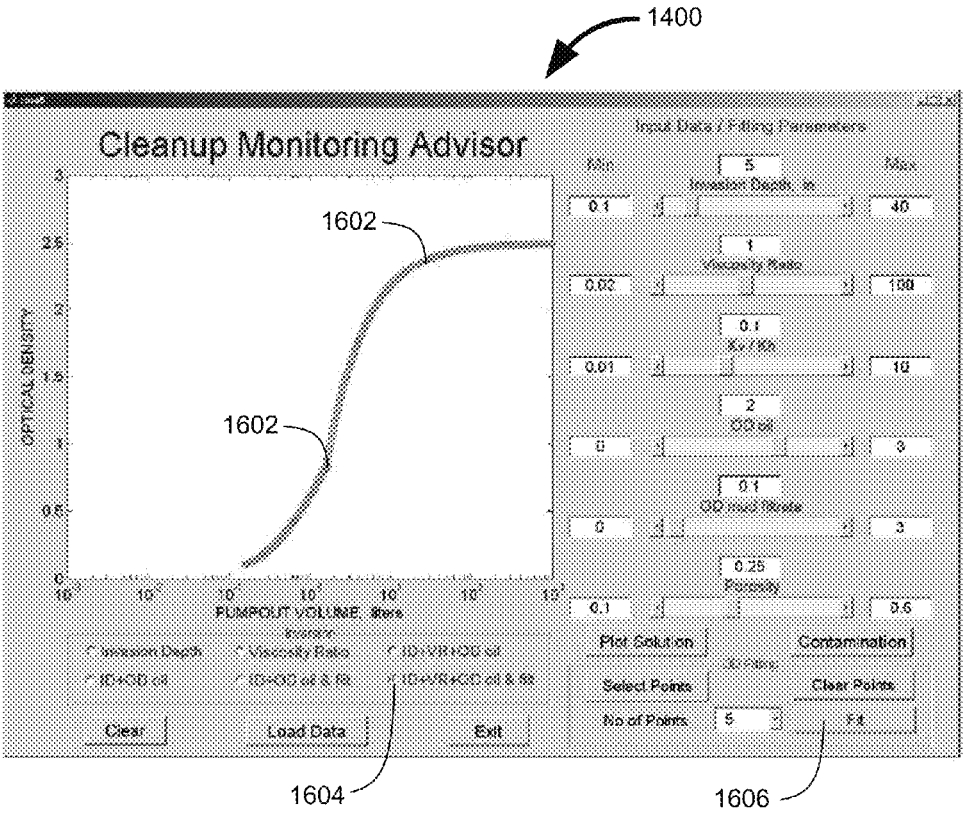
Figure 17:
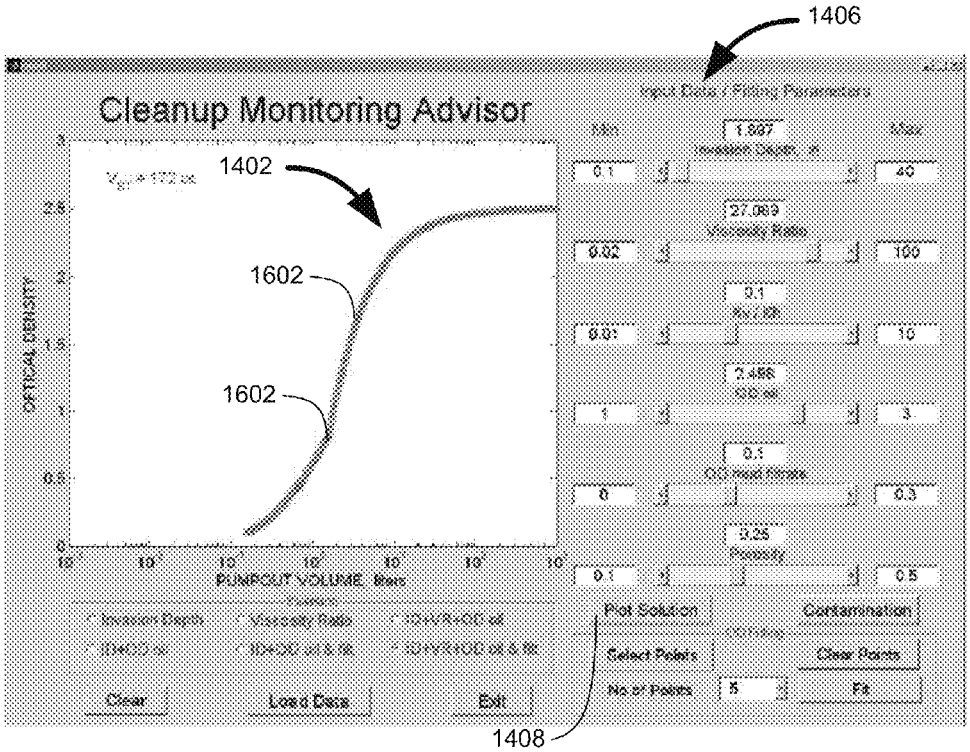

FIG. 16 depicts fitting points 1602 that may have been selected manually using the GUI 1400. The selected fitting points 1602 may be spaced substantially equally relative to a logarithm of pumpout volume. The GUI 1400 of FIG. 16 depicts six inversion options each having a different set of inversion parameters involved in the procedure. However, in other examples, the GUI 1400 may have any other number of inversion options (e.g., 1, 2, 3, 4, etc.). The sixth 1604 inversion option is selected on the GUI 1400 and corresponds to inversion depth+viscosity ratio+optical density of the oil+optical density of the filtrate.

By selecting "Fit" 1606, an inversion may be performed using the inversion engine 310, for example. The boundary values for the inversion may be set by the user prior to performing the inversion via the input boxes and/or slider positions at the input data/fitting parameters 1406 of FIG. 17. By selecting "Plot Solution" 1408, the solution of the forward problem may be displayed at 1402 of FIG. 17 adjacent to and/or on top of the optical monitoring data. As depicted at 1402 of FIG. 17, the solution of the forward problem is consistent with and/or captures the behavior of the fitting points 1602. Similar forward solutions can also be more clearly seen in FIGS. 22 and 24 as thin lines passing through or adjacent to the selected fitting points.

FIGS. 18 and 19 depict field job data that may be associated with validation of the modeling performed using the techniques described herein. 314 stored in the memory 304, for example. The field data contains 23 data sets that cover a wide variety of sampling conditions within an interval of wellbore depth between 16,690 ft. and 18,864 ft. FIG. 18 corresponds to formation properties and FIG. 19 corresponds to job operation parameters. The horizontal lines separating the data sets distinguish sampling operations in four different wells. Some of the formation properties and/or job operation parameters are measured depth (MD), drawdown mobility (DDM), pressure overbalance (PreOver), sample drawdown (Sam DD), pumping time (PO Time) and pumping rate (PO Rate).

FIG. 20 depicts results obtained using a Color model 2002, a GOR model 2004, lab testing 2006 and a cleanup monitoring advisor (CMA) 2008 such as the apparatus 300 (FIG. 3). Reference number 2010 corresponds to the reconstructed depth of invasion. The results obtained at the end of pumping out using the examples described herein depicted at 2008 generated and/or obtained results 5-7 times earlier than the Color model 2002 and the GOR model 20004.

Figure 21:
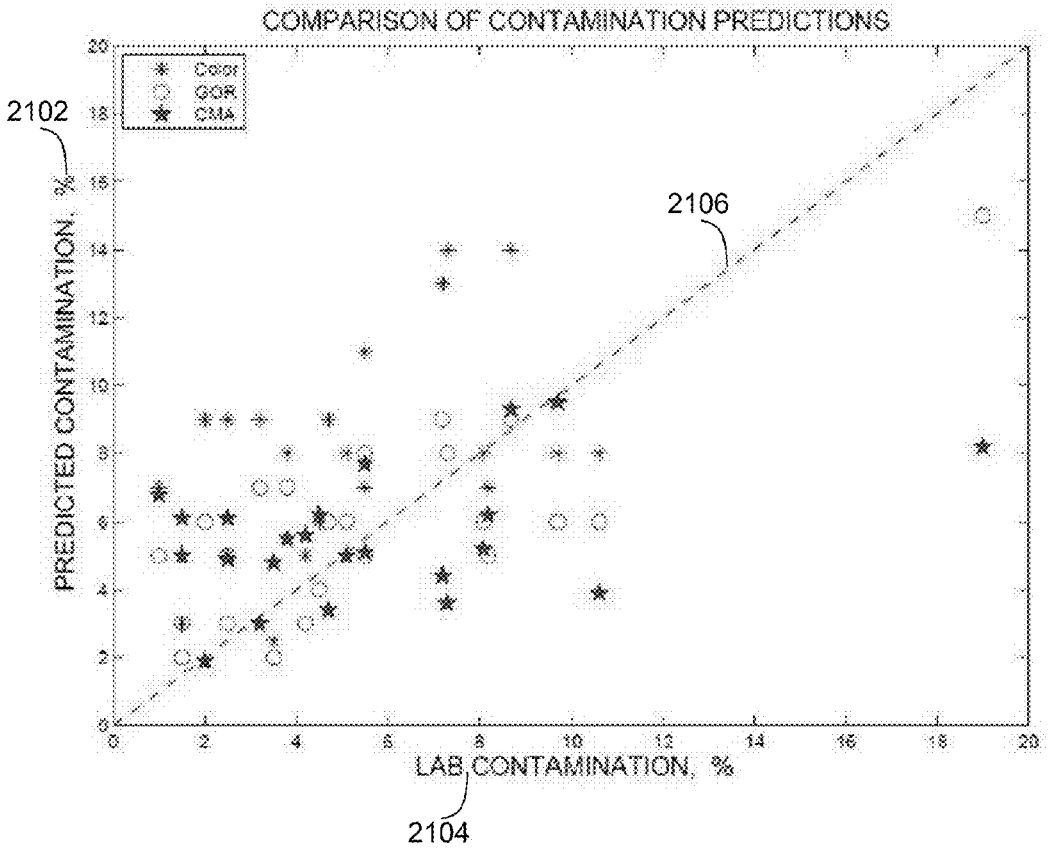
FIG. 21 is an example graph according to one or more aspects of the present disclosure.

FIG. 21 depicts a comparison of the contamination predictions of the Color model, the GOR model and the cleanup monitoring advisor (CMA) such as the apparatus 300 (FIG. 3). The y-axis 2102 of FIG. 21 corresponds to predicted contamination (%) and the x-axis 2104 of FIG. 21 corresponds to lab measured contamination. Each point on the plot may correspond to a processed data set. The CMA inversions have been conducted using early segments of optical monitoring data such as, for example, 7-10 times earlier than the known techniques. The CMA inversions may be accomplished when the optical density curve begins to flatten providing for substantial operational flexibility. Reference number 2106 corresponds to the PVT lab data and the vertical deviation between the PVT lab data and predictions (e.g., the Color model predictions, the GOR predictions and the CMA predictions) corresponds to a measure of discrepancy in the predicted contamination. The data provided below illustrates the standard deviations for three sets of estimates for a contamination range of 2%<c<10% and 0%<c<10%, respectively. The standard deviations below indicate that if small contaminations (c<2%) are excluded, the CMA results are even more accurate.

$$s_{Color}=4.24,\ s_{GOR}=2.26,\ s_{CMA}=1.96$$

$$s_{Color}=4.21,\ s_{GOR}=2.30,\ s_{CMA}=2.55$$

Figure 22:
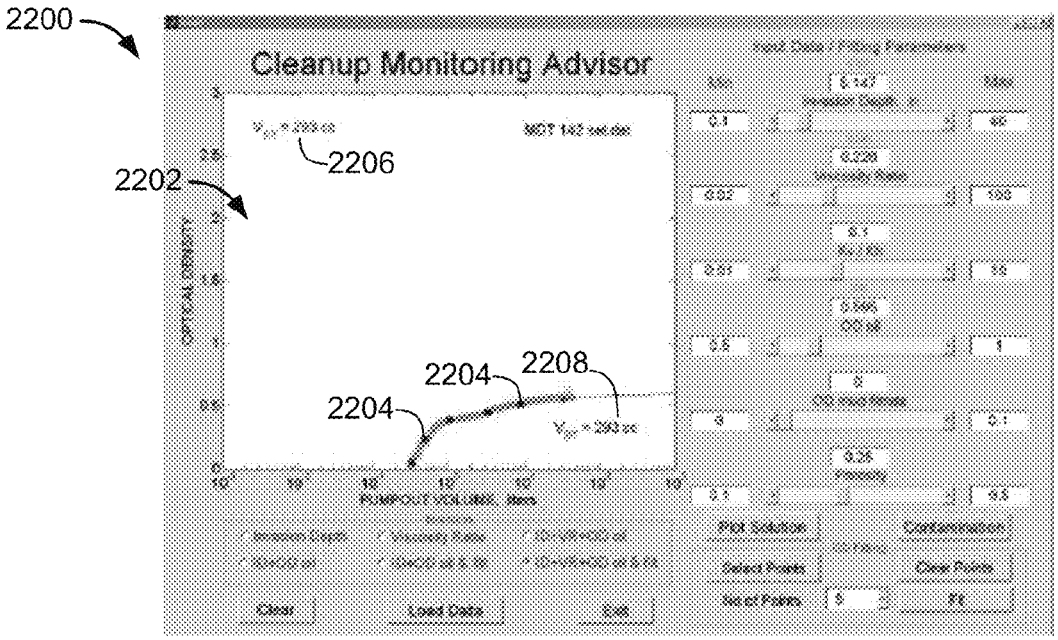
FIGS. 22-25 are example graphical user interfaces according to one or more aspects of the present disclosure.
Figure 23:
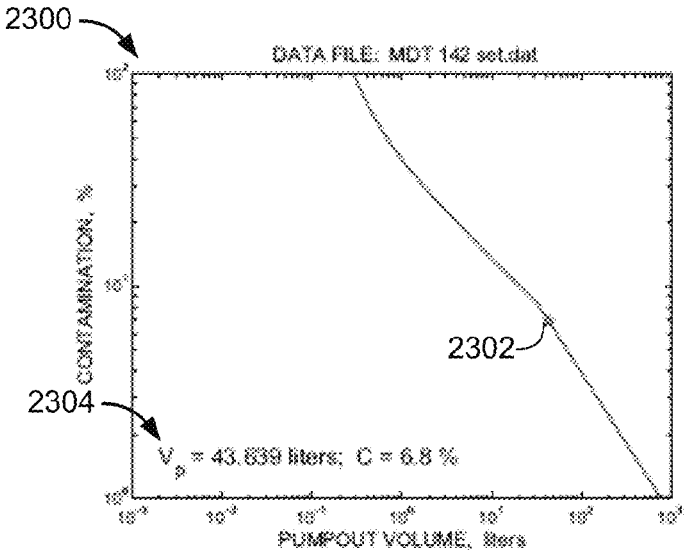

FIGS. 22 and 23 depict graphical user interfaces (GUI) 2200 and 2300 displaying data corresponding to the first data set of FIGS. 18-21. At 2202, computed optical density versus the pumpout volume is plotted adjacent to and/or on top of cleanup monitoring data (e.g., optical monitoring data). In this example, the inversion option used to compute the optical density versus the pumpout volume includes four inversion parameters. However, other inversion options may be selected instead. In this example, the range of the invasion depth was between 0.1 and 40, the range of the viscosity ratio was between 0.02 and 100, the range of the optical density of the formation fluid may be chosen based on the visualized monitoring data and may be between 0.5 and 1.5 optical density units, and a range of the optical density for the mud filtrate may be between 0 and 0.1 or 0.3. However, other ranges may be selected instead.

Reference number 2204 corresponds to the selected fitting points of the optical monitoring data. At 2206, a breakthrough volume of the final solution of inversion may be displayed, and at 2208, a breakthrough volume of a previous iteration of inversion may be displayed.

The GUI 2300 of FIG. 23 depicts the behavior of the contamination (%) versus the pumpout volume (liters). Reference number 2302 corresponds to the ending point of the optical monitoring data. A legend 2304 may display an estimated sample contamination and the final pumpout volume at the ending point of the optical monitoring data.

Figure 24:
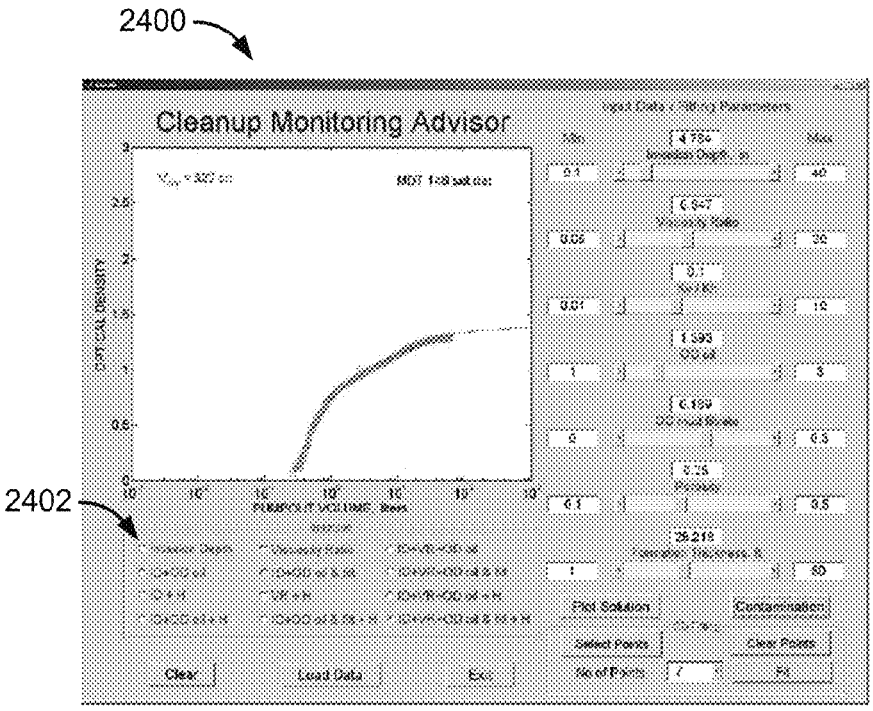
Figure 25:
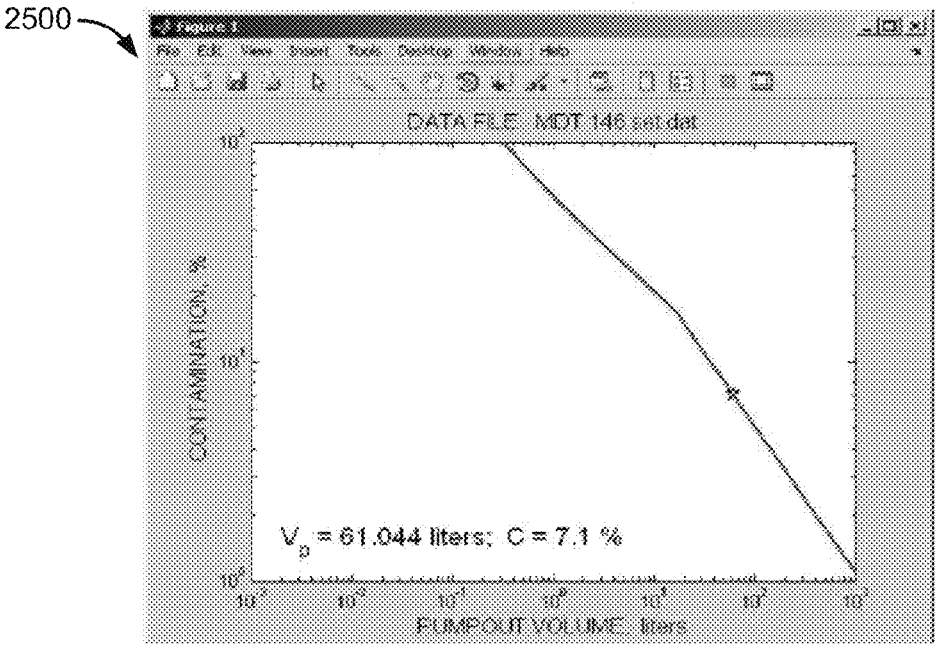

FIGS. 24 and 25 depict graphical user interfaces (GUI) 2400 and 2500. The GUIs 2400 and 2500 are similar to the GUIs 2200 and 2300. However, the GUI 2400 of FIG. 24 includes additional inversion options at 2402. The inversion options include different sets of inversion parameters such as, invasion depth; invasion depth+optical density of the oil; invasion depth+formation thickness; invasion depth+optical density of the oil+formation thickness; viscosity ratio; invasion depth+optical density of the oil+optical density of the filtrate; viscosity ratio+formation thickness; invasion depth+optical density of the oil+optical density of the filtrate+formation thickness; invasion depth+viscosity ratio+optical density of the oil; invasion depth+viscosity ratio+optical density of the oil+optical density of the filtrate; invasion depth+viscosity ratio+optical density of the oil+formation thickness; invasion depth+viscosity ratio+optical density of the oil+optical density of the filtrate+formation thickness. However, other or additional options and/or scenarios may be provided instead.

FIGS. 26 and 27 depict graphs of cleanup predictability detection. The x-axis 2602 of FIG. 26 corresponds to pumpout volumes ($V_1$, $V_2$, $V_3$, etc.) and the y-axis 2604 corresponds to optical density (OD). The x-axis 2702 of FIG. 27 corresponds to pumpout volume and the y-axis 2704 corresponds to contamination (c).

The pumpout volumes ($V_1$, $V_2$, $V_3$, etc.) correspond to the sequentially performed cleanup predictions. The pumpout volumes ($V_{T1}$, $V_{T2}$, $V_{T3}$, etc) correspond to contamination predictions for different times on station ($T_1$; $T_2$, $T_3$, etc.). Once the target contamination profile begins to flatten or converge, the stabilized predictability of cleanup production may be established and/or claimed.

FIGS. 28 and 29 depict graphs of cleanup production predictability. The x-axis 2802 of FIG. 28 corresponds to pumpout volumes ($V_1$, $V_2$, $V_3$, etc.) and the y-axis 2804 corresponds to optical density (OD). The x-axis 2902 of FIG. 29 corresponds to pumpout volume and the y-axis 2904 corresponds to time on station ($T_1$, $T_2$, $T_3$, etc). FIG. 29 illustrates that the time on station can be predicted for different contamination targets ($C_{T1}$, $C_{T2}$, $C_{T3}$, etc.) to detect predictability of cleanup production.

Figure 30:
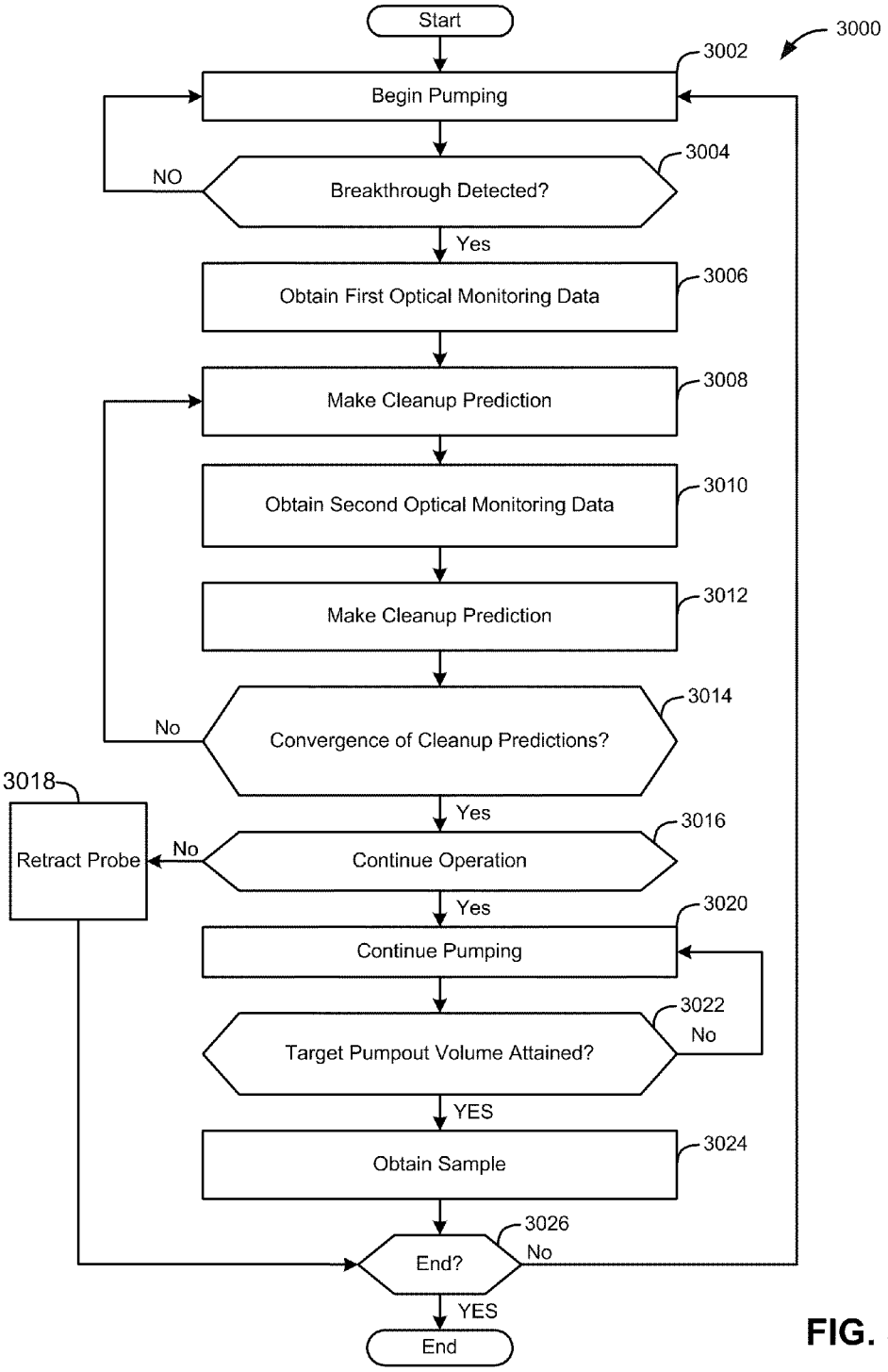
FIGS. 30-32 depict example processes according to one or more aspects of the present disclosure.
Figure 31:
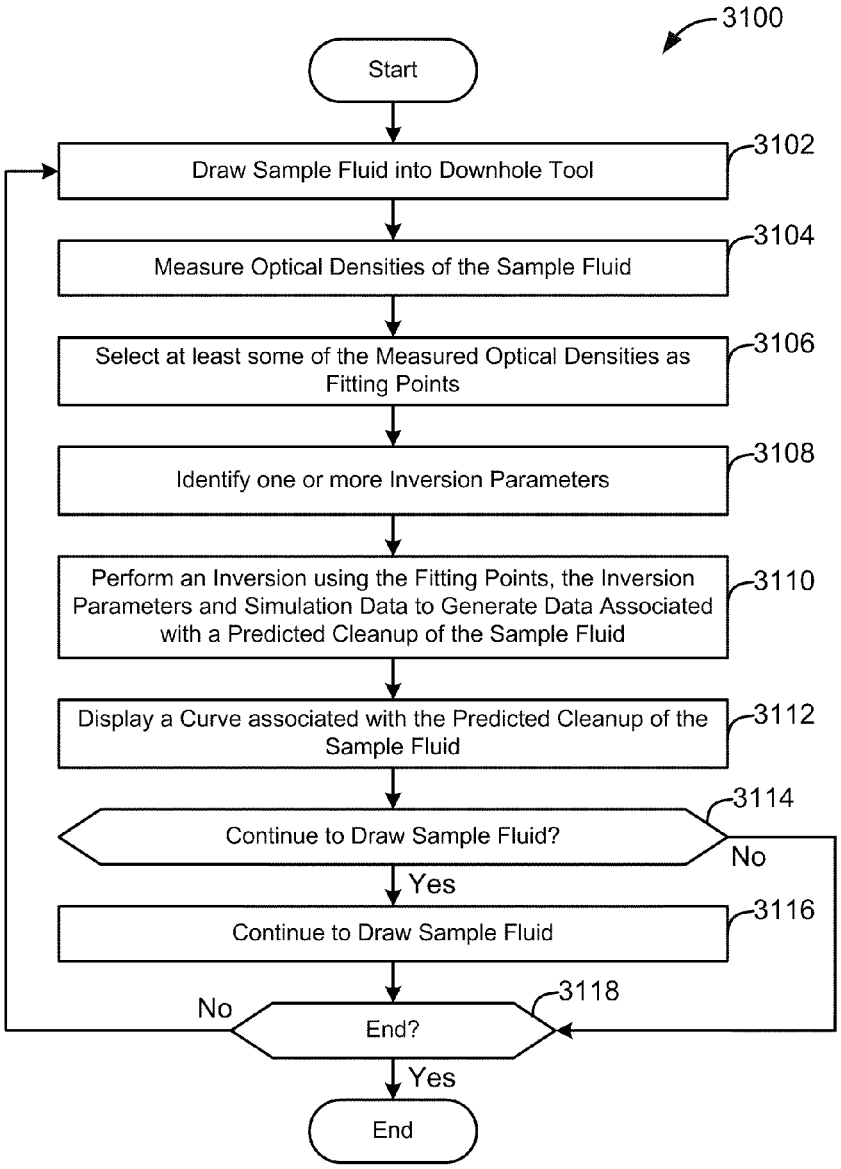
Figure 32:
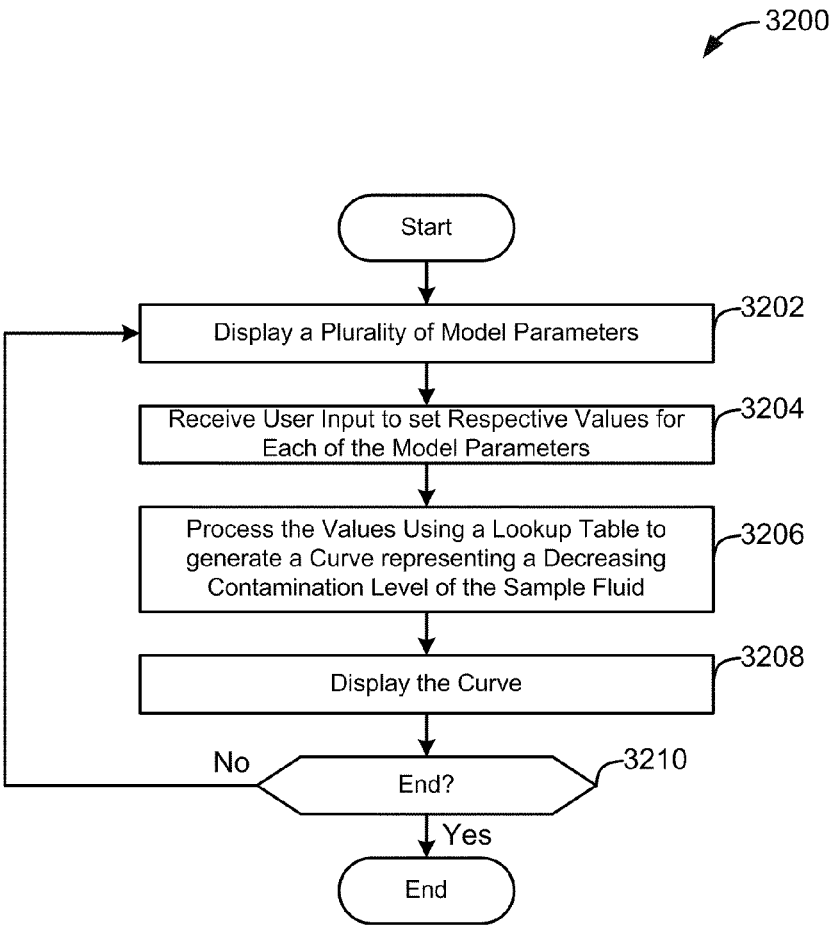

FIGS. 30-32 depict example flow diagrams representative of processes that may be implemented using, for example, computer readable and executable instructions that may be used according to one or more aspects of the present disclosure. The example processes of FIGS. 30-32 may be performed using a processor, a controller and/or any other suitable processing device. For example, the example processes of FIGS. 30-32 may be implemented using coded instructions (e.g., computer readable instructions) stored on a tangible computer readable medium such as a flash memory, a read-only memory (ROM), and/or a random-access memory (RAM). As used herein, the phrase "tangible computer readable medium" is expressly defined to include any type of computer readable storage and to exclude propagating signals. Additionally or alternatively, the example processes of FIGS. 30-32 may be implemented using coded instructions (e.g., computer readable instructions) stored on a non-transitory computer readable medium such as a flash memory, a read-only memory (ROM), a random-access memory (RAM), a cache, or any other storage media in which information is stored for any duration (e.g., for extended time periods, permanently, brief instances, for temporarily buffering, and/or for caching of the information). As used herein, the phrase "non-transitory computer readable medium" is expressly defined to include any type of computer readable medium and to exclude propagating signals.

Alternatively, one or more of the example operations of FIGS. 30-32 may be implemented using any combination(s) of application specific integrated circuit(s) (ASIC(s)), programmable logic device(s) (PLD(s)), field programmable logic device(s) (FPLD(s)), discrete logic, hardware, firmware, etc. Also, one or more of the example operations of FIGS. 30-32 may be implemented manually or as any combination(s) of any of the foregoing techniques, for example, any combination of firmware, software, discrete logic and/or hardware. Further, although the example processes of FIGS. 30-32 are described with reference to the flow diagrams of FIGS. 30-32, other methods of implementing the processes of FIGS. 30-32 may be employed. For example, the order of execution of the blocks may be changed, and/or some of the blocks described may be changed, eliminated, sub-divided, or combined. Additionally, one or more of the example operations of FIGS. 30-32 may be performed sequentially and/or in parallel by, for example, separate processing threads, processors, devices, discrete logic, circuits, etc.

FIG. 30 depicts an example process 3000 that may be used with the example apparatus described herein to predict cleanup during formation sampling. The example process 3000 begins by pumping fluid from the formation (block 3002). The fluid may be pumped to a probe assembly of a downhole tool, for example. As the fluid is being pumped, the process 3000 determines whether or not a breakthrough of virgin formation fluid has been detected (block 3004). The breakthrough of virgin formation fluid may be detected by analyzing the optical density of the fluid being pumped, for example. If the breakthrough of virgin formation fluid has been detected, control moves to block 3006, otherwise, control returns to block 3002.

At block 3006, the process 3000 obtains first optical monitoring data. The first optical monitoring data may include a plurality of optical density measurements (taken at different respective times) of the fluid being pumped, for example. At block 3008, the example process 3000 makes a cleanup prediction. The cleanup prediction may be obtained by selecting some of the optical density values of the first optical monitoring data as fitting points, performing an inversion to predict inversion parameters and predicting a time on station versus a contamination target based on the predicted inversion parameters, for example.

At block 3010, the process 3000 obtains second optical monitoring data and, at block 3012, the process 3000 makes another cleanup prediction.

The process 3000 may then determine whether or not convergence of the cleanup predictions has occurred (block 3014). For example, the process 3000 may determine that convergence has occurred by identifying that the cleanup predictions obtained and/or generated at block 3008 and block 3012 have relatively stabilized and/or are relatively similar. If convergence of the cleanup predictions has occurred, control moves to block 3016, otherwise control returns to block 3008.

At block 3016, the process 3000 determines whether or not to continue the sampling operation. If the process 3000 decides not to continue the operation, control may move to block 3018 and the sampling probe may be retracted from the formation, for example (block 3018).

However, if the process 3000 decides to continue the operation, control moves to block 3020, and the process 3000 continues to pump fluid from the formation (block 3020). At block 3022, the process 3000 determines whether or not a target pumpout volume has been attained. The target pumpout volume may be based on the predicted cleanup and/or associated with a prediction of the amount of fluid to be pumped from the formation to obtain a sample having a particular quality (e.g., a relatively low contamination level), for example. If the process 3000 determines that the target pumpout volume has been obtained, control moves to block 3024 and a sample of the fluid may be obtained. Otherwise, control returns to block 3020.

At block 3026, the process 3000 determines whether or not to return control to block 3002, otherwise the process 3000 is ended.

FIG. 31 depicts an example process 3100 that may be used with the example apparatus described herein to predict cleanup during formation sampling. The process 3100 begins by drawing sample fluid into a downhole tool (block 3102). The downhole tool may be a wireline tool, a drill string tool, etc. The fluid may be drawn from a formation through a probe positioned adjacent thereto. The process 3100 may then measure optical densities of the sample fluid (block 3104). The optical densities may be measured as the fluid is being drawn from the formation at different successive times.

At block 3106, at least some of the measured optical densities may be selected as fitting points and/or parameters. The fitting points may be selected by a user selecting data points from optical monitoring data (e.g., a curve) displayed via a GUI. Alternatively, the fitting points may be selected automatically. In either case, the fitting points may be spaced substantially equally relative to a logarithm of pumpout volume. The number of fitting points may be greater than the number of inversion parameters. For example, the number of fitting points may be equal to or greater than the number of inversion parameters plus one.

At block 3108, one or more inversion parameters are identified. The inversion parameters may be identified by selecting a set of inversion parameters from a plurality of inversion parameters displayed via a GUI. Additionally or alternatively, the inversion parameters may be identified by inputting known or reasonable estimates of the inversion parameters into a GUI.

At block 3110, an inversion is performed using the fitting points, the inversion parameters and/or simulation data to generate data associated with a predicted cleanup of the sample fluid. The simulation data may be generated using at least one dimensionless parameter such as viscosity ratio ($\eta$) or depth of invasion ($\delta$). The simulation data may be associated with a lookup table developed by conducting simulations of flow and contamination transport from the formation to the probe using dimensional analysis for a wide range of input parameters. The input parameters may cover an entire parameter space. The results of these simulations may be approximated and interpolated to create the lookup table, for example.

In practice, during the inversion, one or more inversion parameters may be adjusted based on a global optimization technique such as the Shuffled Complex Evolution Method used in connection with the example lookup table. The inversion enables the predicted cleanup to fit and/or be associated with the measured optical densities.

At block 3112, a curve associated with the predicted cleanup of the sample fluid may be displayed. The curve may be displayed using a GUI, for example. The predicted cleanup may be a plot of predicted contamination versus pumpout volume. Additionally or alternatively, a curve of predicted time on station versus pumpout volume may be displayed using the GUI and/or a curve of predicted optical densities versus pumpout volume may be displayed using the GUI.

At block 3114, the process 3100 determines whether or not to continue to draw sample fluid from the formation. If the process 3100 decides to continue to draw sample fluid, control moves to block 3116 and the sample fluid is continued to be drawn (block 3116).

At block 3118, the process 3100 determines whether or not to return control to block 3102, otherwise the process 3100 is ended.

FIG. 32 depicts an example process 3200 that may be used with the example apparatus described herein to predict cleanup during formation sampling, sampling job planning and/or sensitivity analysis. The process 3200 may begin by displaying a plurality of model parameters via, for example, a GUI (block 3202). The model parameters may include invasion depth, viscosity ratio, optical density of the oil, optical density of the filtrate, formation thickness, etc.

At block 3204, the process 3200 receives user input to set respective values for each of the model parameters. The values may be set arbitrarily, based on experience, based on known or reasonably estimated values, etc.

At block 3206, the process 3200 processes the values using a lookup table to generate a curve representing a decreasing contamination level of the sample fluid. The processing may include finding and/or determining a forward solution to a fluid flow and contamination transport model by interpolation and/or approximation of values of the lookup table. The processing may additionally or alternatively include finding and/or determining optical densities versus pumpout volume and/or time on station versus pumpout volume.

The lookup table may have been generated using a plurality of numerical modeling simulations performed prior to the processing, for example. The lookup table may be generated using at least one dimensionless parameters such as viscosity ratio ($\eta$) or depth of invasion ($\delta$). Further, the lookup table may be generated to correspond to a predetermined sensitivity range for the model parameters. For example, the range of the invasion depth may be between 0.1 and 40, a range of the viscosity ratio may be between 0.02 and 100, a range of the optical density of the formation fluid may be between 0.5 and 1.5 optical density units and/or a range of the optical density for the mud filtrate may be between 0 and 0.1 or 0.3.

At block 3208, the process 3200 displays the curve. The curve may be displayed using a GUI and may be a plot or graph of predicted contamination versus pumpout volume where the predicted contamination decreases as the pumpout volume increases, for example. Additionally or alternatively, a curve may be displayed using a GUI that plots predicted optical densities versus pumpout volume. Additionally or alternatively, a curve may be displayed using a GUI that plots predicted time on station versus pumpout volume.

At block 3210, the process 3200 determines whether or not to return control to block 3202, otherwise the process 3200 is ended.

Figure 33:
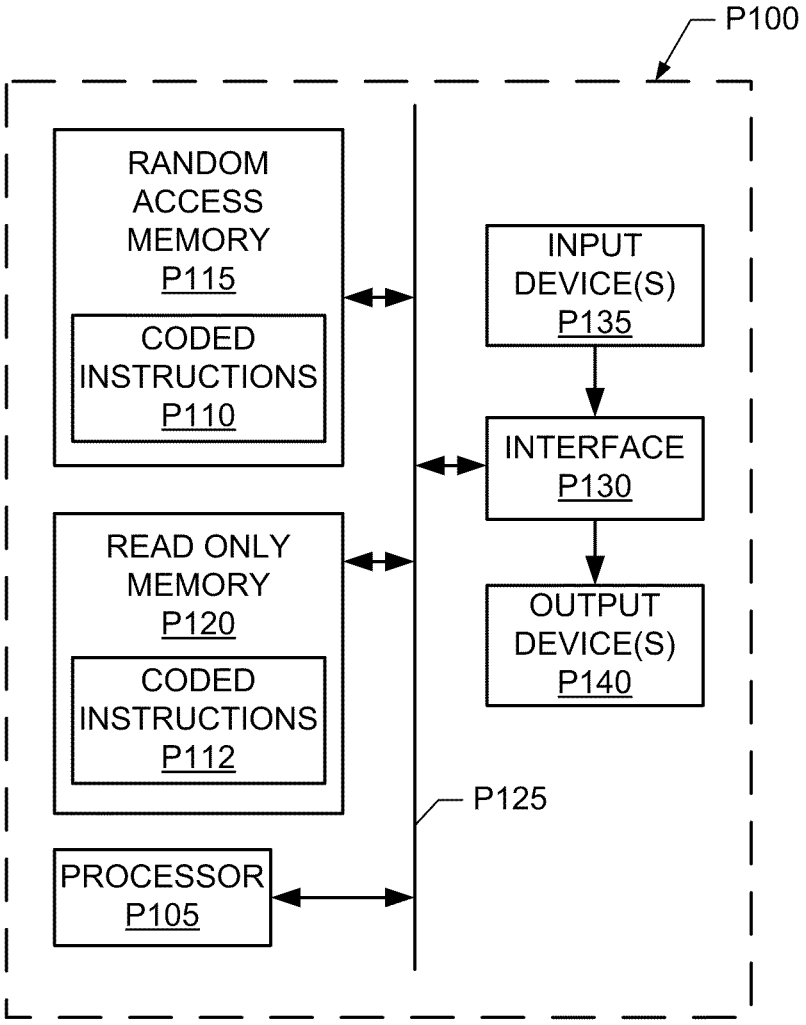
FIG. 33 is a schematic of an example processor platform that may be used and/or programmed to implement the example methods and apparatus described herein.

FIG. 33 is a schematic diagram of an example processor platform P100 that may be used and/or programmed to implement all or a portion of any or all of the example processing units or modules described herein. The processor platform P100 of the example of FIG. 33 includes at least one general-purpose programmable processor P105. The processor P105 executes coded instructions P110 and/or P112 present in main memory of the processor P105 (e.g., within a RAM P115 and/or a ROM P120). The processor P105 may be any type of processing unit, such as a processor core, a processor and/or a microcontroller. The processor P105 may execute, among other things, the example processes described herein or, more generally, to implement the example methods and apparatus described herein.

The processor P105 is in communication with the main memory (including a ROM P120 and/or the RAM P115) via a bus P125. The RAM P115 may be implemented by dynamic random-access memory (DRAM), synchronous dynamic random-access memory (SDRAM), and/or any other type of RAM device, and ROM may be implemented by flash memory and/or any other desired type of memory device. Access to the memory P115 and the memory P120 may be controlled by a memory controller (not shown).

The processor platform P100 also includes an interface circuit P130. The interface circuit P130 may be implemented by any type of interface standard, such as an external memory interface, serial port, general-purpose input/output, etc. One or more input devices P135 and one or more output devices P140 are connected to the interface circuit P130.

In view of all of the above and the figures, it should be readily apparent to those skilled in the art that the present disclosure introduces a method comprising: predicting cleanup of a sample fluid obtained by a downhole tool by: drawing the sample fluid into the downhole tool via a probe assembly; measuring optical densities of the sample fluid at a plurality of different respective times; selecting at least some of the measured optical densities as fitting points; identifying one or more inversion parameters; and performing, via a processor, an inversion using the fitting points, the inversion parameters and simulation data to generate data associated with a predicted cleanup of the sample fluid. The number of fitting points may be greater than the number of inversion parameters. The selected optical densities may correspond to times subsequent to detecting a breakthrough of formation fluid. The method may further comprise repeating the measuring, selecting, identifying and performing operations to determine whether a convergence of the predicted cleanup has occurred. The method may further comprise determining whether to continue drawing the sample fluid into the downhole tool in response to determining that the convergence of the predicted cleanup has occurred. The method may further comprise continuing drawing the sample fluid until a pumpout volume equals or exceeds a target pumpout volume, the target pumpout volume being based on the predicted cleanup. The measured optical densities may be selected so that the measured optical densities are spaced substantially equally relative to a logarithm of pumpout volume. The simulation data may be generated using at least one dimensionless parameter. The selecting may be performed via a graphical user interface. The selecting may be performed by a user selecting data points from a curve displayed via the graphical user interface. The selecting may be performed automatically. The identifying of inversion parameters may be performed via a graphical user interface. The identifying of inversion parameters may be performed by a user selecting a set of inversion parameters from a plurality of sets of inversion parameters displayed via the graphical user interface. The method may further comprise displaying a curve associated with the predicted cleanup of the sample fluid via a graphical user interface. The method may further comprise displaying the curve together with at least one of the measured optical densities, the fitting points, or the inversion parameters. The downhole tool may comprise a wireline tool or a drill string tool.

The present disclosure also introduces a method comprising: predicting cleanup of a sample fluid obtained by a downhole tool by: displaying a plurality of model parameters via a graphical user interface; receiving user inputs via the graphical user interface to set respective values for each of the model parameters; processing the values using a lookup table to generate a curve representing a decreasing contamination level of the sample fluid, the lookup table including data generated via a plurality of numerical modeling simulations performed prior to the processing of the values; and displaying the curve via the graphical user interface. The lookup table data may be generated using at least one dimensionless parameter. The lookup table data may be generated to correspond to a predetermined input sensitivity range for the model parameters. The processing may comprise finding a forward solution to a fluid transport model. The processing may comprise using at least one of interpolation, limited range extrapolation or approximation to find the forward solution to the formation fluid transport model. The displaying the curve may comprise displaying the curve to have a decreasing contamination level as a pumpout volume increases. The downhole tool may comprise a wireline tool or a drill string tool.

The present disclosure also introduces an apparatus comprising: a downhole tool configured for conveyance within a wellbore extending into a subterranean formation, wherein the downhole tool is further configured for predicting cleanup of a sample fluid obtained by a downhole tool, and wherein the downhole tool comprises: a memory storing lookup table data, the lookup table data comprising data associated with simulations based on a fluid transport model; and a processing unit to receive a plurality of fitting points, each of the fitting points corresponding to a respective measured optical density of the sample fluid, and to receive one or more inversion parameters, each of the received inversion parameters corresponding to a parameter of the fluid transport model, wherein the processing unit is to perform an inversion using the fitting points and the inversion parameters to generate data associated with a predicted cleanup of the sample fluid.

The present disclosure also introduces a system comprising: a downhole tool configured for conveyance within a wellbore extending into a subterranean formation, wherein the downhole tool is further configured for predicting cleanup of a sample fluid obtained by a downhole tool, and wherein the downhole tool comprises: a probe assembly to draw the sample fluid into the downhole tool; a fluid analyzer to measure optical densities of the sample fluid at a plurality of different respective times; a graphical user interface to enable automatic or user selection of at least some of the measured optical densities as fitting points and to identify one or more inversion parameters; and a processing unit to perform an inversion using the fitting points and the inversion parameters to generate data associated with a predicted cleanup of the sample fluid.

The present disclosure also introduces a method comprising: predicting fluid characteristics of a sample fluid obtained by a downhole tool by: drawing the sample fluid into the downhole tool via a probe assembly; measuring one or more parameters of the sample fluid at a plurality of different respective times; selecting at least some of the measured one or more parameters as fitting points; identifying one or more inversion parameters; and performing, via a processor, an inversion using the fitting points, the inversion parameters and simulation data to generate data associated with a predicted fluid characteristic of the sample fluid.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A method for predicting cleanup of a wellbore fluid sample, the method comprising:

(a) drawing the fluid sample into a downhole tool via a probe assembly;

(b) measuring optical densities of the fluid sample at a plurality of different times while drawing the fluid sample in (a);

(c) selecting a plurality of the optical densities measured in (b);

(d) processing a fluid transport model to compute theoretical optical densities as a function of a pumpout volume of the fluid sample; and (e) causing a processor to adjust one or more inversion parameters in the fluid transport model to obtain a fit between the optical densities selected in (c) and the theoretical optical densities computed in (d), wherein the inversion parameters include (i) a depth of mud filtrate invasion, (ii) a viscosity ratio between a formation fluid and an oil based mud filtrate, (iii) a formation thickness, (iv) an optical density of the formation fluid, and (v) an optical density of the oil based mud filtrate.

2. The method of claim 1 wherein the number of optical densities selected in (c) is greater than the number of inversion parameters adjusted in (e).

3. The method of claim 1 wherein the optical densities selected in (c) correspond to times subsequent to detecting a breakthrough of formation fluid.

4. The method of claim 1 further comprising:

(f) repeating (b), (c), (d), and (e), to determine whether a convergence of the predicted cleanup has occurred.

5. The method of claim 4 further comprising:

(g) determining whether to continue drawing the sample fluid into the downhole tool in response to determining whether the convergence of the predicted cleanup has occurred in (f).

6. The method of claim 1 wherein the measured optical densities are selected so that the measured optical densities are spaced substantially equally relative to a logarithm of pumpout volume.

7. The method of claim 1 wherein the simulation data is generated using at least one dimensionless parameter.

8. The method of claim 1 wherein the selecting in (c) is performed via a graphical user interface.

9. The method of claim 8 wherein the selecting is performed by a user selecting data points from a curve displayed via the graphical user interface.

10. The method of claim 1 wherein the selecting in (c) is performed automatically.

11. The method of claim 1 wherein the one or more inversion parameters adjusted in (e) are selected via user input using a graphical user interface.

12. The method of claim 1 further comprising:

(f) causing a first curve associated with the predicted cleanup of the sample fluid to be displayed via a graphical user interface.

13. The method of claim 12 further comprising:

(g) causing the first curve to be displayed together with at least one of the optical densities measured in (b), the optical densities selected in (c), and the inversion parameters adjusted in (e).

14. The method of claim 12 further comprising:

(g) varying at least one of the inversion parameters adjusted in (e); and (h) causing a second curve associated with the predicted cleanup of the sample fluid to be displayed on the graphical user interface simultaneously with the first curve.

15. The method of claim 1 wherein the downhole tool comprises a wireline tool or a drill string tool.

16. The method of claim 1, further comprising:

(f) processing the fluid transport model using the inversion parameters adjusted in (e) to obtain a predicted contamination of the fluid sample as a function of pumpout volume.

17. The method of claim 1, further comprising:

(f) processing the fluid transport model using the inversion parameters adjusted in (e) to obtain a predicted pumpout volume based on contamination targets for the fluid sample.

18. The method of claim 1, wherein the fluid sample is drawn in (a) until a pumpout volume equals or exceeds the predicted pumpout volume.

19. The method of claim 1, further comprising:

(f) processing the fluid transport model using the inversion parameters adjusted in (e) to obtain a predicted time on station based on contamination targets for the fluid sample.

20. A downhole tool comprising:

a downhole tool body configured for conveyance within a wellbore extending into a subterranean formation, a probe assembly configured for drawing a fluid sample into the downhole tool;

a controller configured to predict cleanup of a fluid sample, the controller including:

a memory storing lookup table, the lookup table data comprising a plurality of optical density data associated with simulations using a fluid transport model at a corresponding plurality of inversion parameter values, the inversion parameters including (i) a depth of mud filtrate invasion, (ii) a viscosity ratio between a formation fluid and an oil based mud filtrate, (iii) a formation thickness, (iv) an optical density of the formation fluid, and (v) an optical density of the oil based mud filtrate; and a processing unit configured to (i) receive a plurality of optical density measurements as a function of time while drawing a fluid sample into the downhole tool, and (ii) process the optical density measurements received in (i) in conjunction with the optical density data stored in the look-up table to generate data associated with a predicted cleanup of the sample fluid in real-time while drawing the fluid sample into the downhole tool.

21. A method for predicting cleanup of a wellbore fluid sample, the method comprising:

(a) processing a fluid transport model a plurality of times to compute corresponding theoretical optical densities as a function of a pumpout volume of the fluid sample over predetermined ranges of inversion parameter values;

(b) storing the optical densities computed in (a) in a look-up table;

(c) drawing the fluid sample into a downhole tool via a probe assembly after said processing and storing in (a) and (b);

(d) measuring optical densities of the fluid sample at a plurality of different times while drawing the fluid sample in (c);

(e) selecting a plurality of the optical densities measured in (d); and (f) causing a processor to process the optical densities measured in (d) in conjunction with the optical densities stored in the look-up table in (b) to compute the inversion parameter values in real-time while drawing the fluid sample into the downhole tool in (c), wherein the inversion parameters include (i) a depth of mud filtrate invasion, (ii) a viscosity ratio between a formation fluid and an oil based mud filtrate, (iii) a formation thickness, (iv) an optical density of the formation fluid, and (v) an optical density of the oil based mud filtrate.

* * * * *